US009892901B2

(12) United States Patent
Hasegawa et al.

(10) Patent No.: US 9,892,901 B2
(45) Date of Patent: Feb. 13, 2018

(54) MASS SPECTROMETRY DEVICE

(71) Applicant: HITACHI HIGH-TECHNOLOGIES CORPORATION, Minato-ku, Tokyo (JP)

(72) Inventors: Hideki Hasegawa, Tokyo (JP); Hiroyuki Satake, Tokyo (JP); Masao Suga, Tokyo (JP); Yuichiro Hashimoto, Tokyo (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 15/324,092

(22) PCT Filed: Jun. 15, 2015

(86) PCT No.: PCT/JP2015/067109

§ 371 (c)(1),
(2) Date: Jan. 5, 2017

(87) PCT Pub. No.: WO2016/006390

PCT Pub. Date: Jan. 14, 2016

(65) Prior Publication Data

US 2017/0162375 A1 Jun. 8, 2017

(30) Foreign Application Priority Data

Jul. 7, 2014 (JP) ..... 2014-139292

(51) Int. Cl.
*H01J 49/24* (2006.01)
*H01J 49/34* (2006.01)
(Continued)

(52) U.S. Cl.
CPC ..... *H01J 49/24* (2013.01); *H01J 49/0422* (2013.01); *H01J 49/165* (2013.01); *H01J 49/34* (2013.01)

(58) Field of Classification Search
USPC ..... 250/288
See application file for complete search history.

(56) References Cited

U.S. PATENT DOCUMENTS 5,504,327 A * 4/1996 Sproch ..... H01J 49/049 250/281
5,756,994 A 5/1998 Bajic
(Continued)

FOREIGN PATENT DOCUMENTS

CN 103635797 A 3/2014
JP 10-185876 A 7/1998
(Continued)

OTHER PUBLICATIONS

Office Action dated Aug. 31, 2017 for related Chinese Application No. 201580031359.8.

*Primary Examiner* — Phillip A Johnston
(74) *Attorney, Agent, or Firm* — Miles & Stockbridge P.C.

(57) ABSTRACT

A mass spectrometry device that can perform highly robust, highly sensitive, and low-noise analysis and addresses the problems of preventing reductions in ion transfer efficiency and of suppressing the introduction of noise components from droplets, etc. An ion source generates ions, a vacuum chamber is evacuated by an evacuation means and for analyzing the mass of ions, and an ion introduction electrode introduces ions into the vacuum chamber. The ion introduction electrode has an ion-source-side front-stage pore, a vacuum-chamber-side rear-stage pore, and an intermediate pressure chamber between the front-stage pore and the rear-stage pore, the cross-sectional area of an ion inlet of the intermediate pressure chamber is larger than the cross-sectional area of the front-stage pore, the position of the central axis of the front-stage pore and the position of the central axis of the rear-stage pore are eccentric, and the
(Continued)

cross-sectional area of an ion outlet of the intermediate pressure chamber is smaller than the cross-sectional area of the ion inlet.

16 Claims, 20 Drawing Sheets

(51) Int. Cl.
*H01J 49/16* (2006.01)
*H01J 49/04* (2006.01)

(56) References Cited

U.S. PATENT DOCUMENTS 5,986,259 A 11/1999 Hirabayashi et al.
6,169,370 B1 * 1/2001 Platzer ..... H05H 1/30 219/121.36
6,700,119 B1 3/2004 Giles
6,872,940 B1 * 3/2005 Thakur ..... H01J 49/067 250/282
7,053,367 B2 * 5/2006 Tobita ..... H01J 49/044 250/281
8,921,803 B2 * 12/2014 Welkie ..... H01J 37/12 250/288
9,165,753 B2 * 10/2015 Loboda ..... H01J 49/164
9,177,775 B2 * 11/2015 Hasegawa ..... H01J 49/0431
2003/0189169 A1 10/2003 Wells et al.
2004/0056189 A1 3/2004 Tanner et al.
2009/0050801 A1 2/2009 Fedorov
2009/0283674 A1 11/2009 Pesch
2011/0147575 A1 6/2011 Mordehai et al.
2014/0131570 A1 5/2014 Yoshioka et al.
2015/1001392 1/2015 Hasegawa et al.

FOREIGN PATENT DOCUMENTS

JP 2004-507875 A 3/2004
JP 2010-508642 A 3/2010
JP 2010-157499 A 7/2010
JP 2013-149539 A 8/2013
WO 98/14811 4/1998
WO 2013/111485 A1 8/2013

* cited by examiner

MASS SPECTROMETRY DEVICE

TECHNICAL FIELD

The present invention relates to a mass spectrometry device that is highly robust and can perform highly sensitive and low-noise analyses.

BACKGROUND ART

Ordinary atmospheric pressure ionization mass spectrometry devices are configured to introduce ions generated under atmospheric pressure into vacuum and analyze the mass of the ions.

Ion sources for generating ions under atmospheric pressure are available in a variety of types, including electrospray ionization (ESI) type, atmospheric pressure chemical ionization (APCI) type, matrix-assisted laser desorption-ionization (MALDI) type, and the like. In any type, a substance that makes a noise component is produced in addition to desired ions. For example, ESI ion sources are configured to ionize a sample by applying high voltage while pouring a sample solution into a small-diameter metal capillary. For this reason, noise components, such as charged droplets and neutral droplets, are also produced at the same time as ions.

An ordinary mass spectrometry device is composed of several spaces partitioned by a pore and each space is evacuated by a vacuum pump. The spaces are increased in degree of vacuum (reduced in pressure) as it goes rearward. A first space separated from atmospheric pressure by a first pore electrode (AP1) is often evacuated by a rotary pump or the like and kept at a degree of vacuum of several hundreds of Pa or so. A second space partitioned from the first space by a second pore electrode (AP2) is provided with an ion transport unit (quadrupole electrode, electrostatic lens electrode, or the like) that converges and transmits ions. The second space is often evacuated to several Pa or so by a turbo molecular pump or the like. A third space partitioned from the second space by a third pore electrode (AP3) is provided with: an ion analysis unit (ion trap, quadrupole filter electrode, collision cell, time-of-flight mass spectrometer (TOF), or the like) for ion separation and dissociation; and a detection unit for detecting ions. The third space is often evacuated to 0.1 Pa or below by a turbo molecular pump or the like. There are also mass spectrometry devices with more than three partitioned spaces but devices including three spaces or so are in common use.

Generated ions and the like (including noise components) pass through AP1 and are introduced into a vacuum vessel. The ions thereafter pass through AP2 and are converged on the central axis at the ion transport unit. The ions thereafter pass through AP3 and are separated by mass or decomposed at the ion analysis unit. Thus, the structure of the ions can be analyzed in more detail. The ions are finally detected at the detection unit.

In most typical mass spectrometers, AP1, AP2, and AP3 are often coaxially disposed. The above-mentioned droplets other than ions are less susceptible to the electric field of the pore electrode, ion transport unit, and ion analysis unit and basically tend to travel in a straight line. For this reason, if droplets traveling in a straight line are excessively introduced, the droplets can arrive at a detector and this leads to a shortened life of the detector.

To address this problem, in the technology described in Patent Literature 1, a member having multiple holes is placed between an ion source and AP1. This member does not have a hole positioned coaxially with AP1 and the introduction of noise components from AP1 can be reduced. However, the member having the multiple holes is disposed outside AP1, and the front face and back face of the member are both placed at atmospheric pressure.

To remove droplets traveling in a straight line, the central axis of AP1 and the central axis of AP2 are made orthogonal to each other in the technology described in Patent Literature 2; and the central axis of AP1 and the central axis of AP2 are eccentrically disposed in the technology described in Patent Literature 3. However, in the equipment configurations in Patent Literature 2 and Patent Literature 3, a right-angled space between AP1 and AP2 is evacuated in a direction orthogonal to the central axis of AP2 by a vacuum exhaust pump such as a rotary pump. FIG. 1 in Patent Literature 4 illustrates an equipment configuration in which the central axis of AP1 is cranked.

CITATION LIST

Patent Literature

PTL 1: U.S. Pat. No. 5,986,259
PTL 2: U.S. Pat. No. 5,756,994
PTL 3: U.S. Pat. No. 6,700,119
PTL 4: Japanese Patent Application Laid-Open No. 2010-157499

SUMMARY OF INVENTION

Technical Problem

In the equipment configuration described in Patent Literature 1, the upstream side of AP1 is under atmospheric pressure and a pressure difference between an inlet and an outlet of AP1 is increased. For this reason, a flow is brought into a sound velocity state in proximity to an outlet of AP1 and this can produce a Mach disk. Since a flow is disturbed by a Mach disk in proximity to an outlet of AP1, the efficiency of ion introduction to AP2 is degraded.

In the equipment configuration in Patent Literature 2 or Patent Literature 3, a right-angled space between AP1 and AP2 is evacuated in a direction orthogonal to the central axis of AP2 by a vacuum exhaust pump such as a rotary pump. For this reason, even ions are exhausted together with noise components such as droplets and this causes an ion loss and incurs degradation in sensitivity.

In the equipment configuration in Patent Literature 4, the central axes of AP1 and AP2 are in eccentric positional relation because of a cranked flow path but the flow path is substantially constant in inside diameter from an inlet toward an outlet of AP1. For this reason, a flow is made laminar and the flow is more intensified by pipe friction as it is brought closer to the center of the pipe. As a result, there is a possibility that a noise factor such as droplets flows out of an outlet of AP1 as well together with the flow. As in Patent Literature 1, there is a large pressure difference between an inlet and an outlet of AP1; therefore, a flow is brought into a sound velocity state in proximity to an outlet of AP1 and this can cause a Mach disk. For this reason, a flow is disturbed in proximity to an outlet of AP1 by a Mach disk and the efficiency of ion introduction to AP2 is degraded.

Solution to Problem

To address the above problems, a mass spectrometry device of the present invention is provided with: an ion source that generates ions; a vacuum chamber that is evacuated by an evacuation means and is for analyzing the mass of ions; and an ion introduction electrode that introduces ions into the vacuum chamber. The present invention is characterized in that: the ion introduction electrode has an ion source-side front-stage pore, a vacuum chamber-side rear-stage pore, and an intermediate pressure chamber located between the front-stage pore and the rear-stage pore; the cross-sectional area of an ion inlet of the intermediate pressure chamber is larger than the cross-sectional area of the front-stage pore; the central axis of the front-stage pore and the central axis of the rear-stage pore are eccentrically positioned; and the cross-sectional area of an ion outlet of the intermediate pressure chamber is smaller than the cross-sectional area of an ion inlet thereof.

The present invention is further characterized in that the angle formed between the wall surface of the intermediate pressure chamber and the direction of the central axis of the front-stage pore is acute. In particular, it is desirable that the angle formed between the wall surface of the intermediate pressure chamber and the direction of the central axis of the front-stage pore should be 15° to 75°.

Further, it is desirable that the pressure in the intermediate pressure chamber should be 2000 to 30000 Pa. When $P_o$ is taken for the primary-side pressure of the front-stage pore and $P_M$ is taken for the secondary-side pressure thereof, it is desirable that $P_M/P_o \leq 0.5$.

Advantageous Effects of Invention

The present invention enables implementing a mass spectrometry device of high robustness and sensitivity and low noise.

DESCRIPTION OF EMBODIMENTS

Example 1

With respect to a first example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the first example is characterized in that: there is provided such a tapered intermediate pressure chamber that the internal cross-sectional area thereof is continuously reduced as it goes along the traveling direction of ions.

Figure 1:
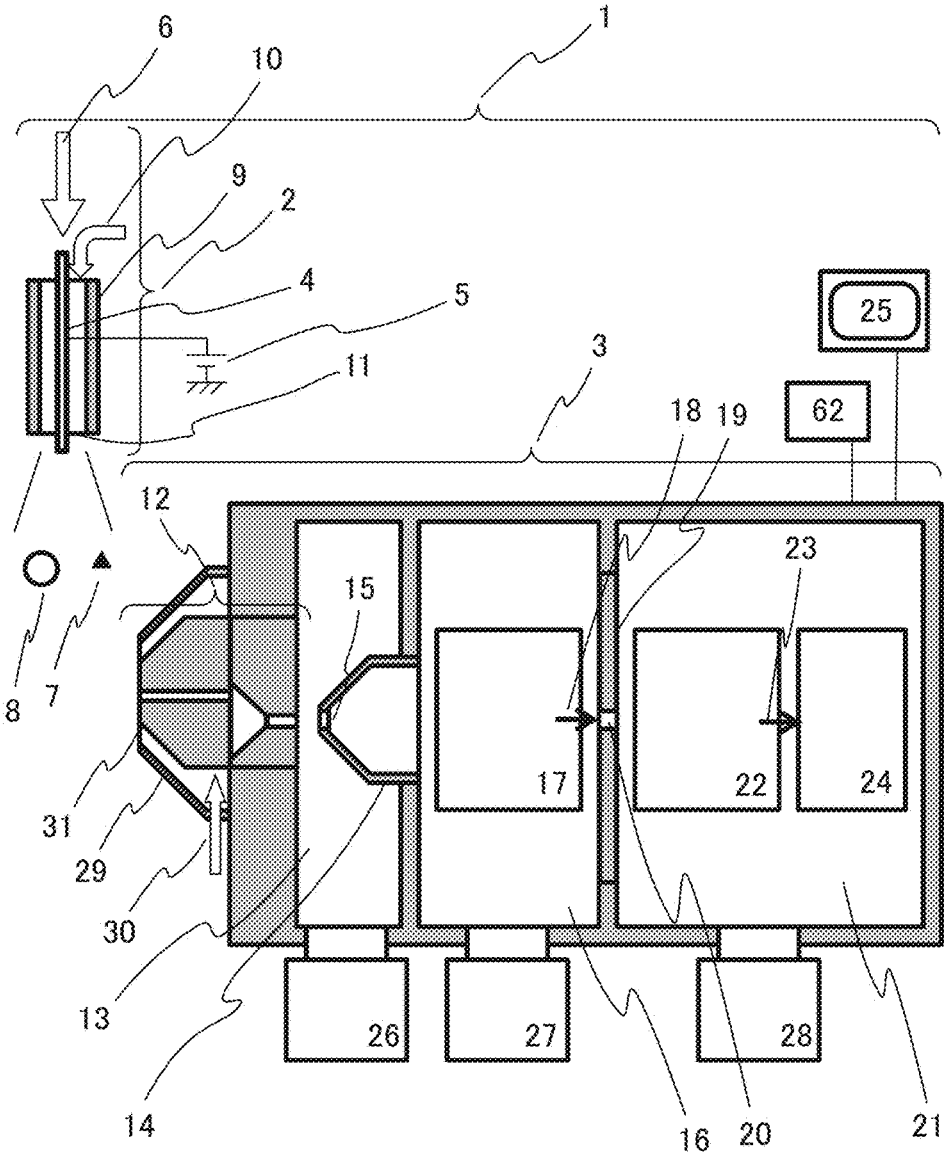
FIG. 1 is an equipment configuration drawing of a first example.

FIG. 1 is an explanatory drawing illustrating a configuration of a mass spectrometry device using the above characteristic. The mass spectrometry device 1 is made up mainly of an ion source 2 placed under atmospheric pressure and a vacuum vessel 3. The ion source 2 shown in FIG. 1 generates the ions of a sample solution on a principle designated as electrospray ionization (ESI) scheme. According to the principle of ESI scheme, the ions 7 of a sample solution 6 are generated by supplying the sample solution 6 into a metal capillary 4 while applying high voltage thereto from a power supply 5. In the process of the ion generation principle by the ESI scheme, the droplets 8 of the sample solution 6 are repeatedly fragmented and finally turned into very fine droplets and ionized. Droplets that cannot be sufficiently turned into fine droplets in the process of ionization include neutral droplets, charged droplets, and the like. To reduce these droplets 8, a pipe 9 is provided outside the metal capillary 4 and gas 10 is let to flow therebetween. Then the gas 10 is sprayed form an outlet end 11 of the pipe 9 to facilitate vaporization of the droplets 8.

The ions 7 and droplets 8 generated under atmospheric pressure pass through an ion introduction electrode 12 and are introduced into a first vacuum chamber 13. The ions 7 thereafter pass through a hole 15 formed in a second pore electrode 14 and are introduced into a second vacuum chamber 16. The second vacuum chamber 16 is provided with an ion transport unit 17 that converges and transmits ions. For the ion transport unit 17, a quadrupole electrode, an electrostatic lens electrode, or the like can be used. The ions 18 that passed through the ion transport unit 17 pass through a hole 20 formed in a third pore electrode 19 and are introduced into a third vacuum chamber 21. The third vacuum chamber 21 is provided with an ion analysis unit 22 for ion separation and dissociation. For the ion analysis unit 22, an ion trap, a quadrupole filter electrode, a collision cell, a time-of-flight mass spectrometer (TOF), or the like can be used. The ions 23 that passed through the ion analysis unit 22 are detected at a detector 24. For the detector 24, an electron multiplier, a multi-channel plate (MCP), or the like can be used. The ions 23 detected at the detector 24 are converted into electrical signals or the like and information such as the mass, strength, and the like of the ions can be analyzed in details at a control unit 25. The control unit 25 has an input/output unit, a memory, and the like for accepting instruction input from a user and controlling voltage and the like and also includes software and the like required for power supply operation.

The first vacuum chamber 13 is evacuated by a rotary pump (RP) 26 and held at several hundreds of Pa or so. The second vacuum chamber 16 is evacuated by a turbo molecular pump (TMP) 27 and held at several Pa or so. The third vacuum chamber 21 is evacuated by TMP 28 and held at 0.1 Pa or below. Further, such an electrode 29 as shown in FIG. 1 is disposed outside the ion introduction electrode 12 and gas 30 is introduced into a gap therebetween. The gas is then sprayed from an outlet end 31 of the electrode 29 to reduce droplets 8 introduced into the vacuum vessel 3.

When the device is used, direct-current or alternating-current voltage is applied from a power supply 62 to the ion introduction electrode 12, second pore electrode 14, ion transport unit 17, third pore electrode 19, ion analysis unit 22, detector 24, electrode 29, and the like.

A detailed description will be given to a configuration of an ion introduction electrode 12 in the first example with reference to FIGS. 2(A) and 2(B). FIG. 2(A) illustrates the introduction electrode 12 as viewed from the ion source 2 side; and FIG. 2(B) illustrates a section of the ion introduction electrode 12 taken along the central axis thereof. The ion introduction electrode 12 is composed mainly of three elements: a front-stage first pore 35, an intermediate pressure chamber 33, and a rear-stage first pore 36. The front-stage first pore 35 is $\Phi d_1$ in inside diameter and $L_1$ in length; and the rear-stage first pore 36 is $\Phi d_2$ in inside diameter and $L_2$ in length. The intermediate pressure chamber 33 located between the front-stage first pore 35 and the rear-stage first pore 36 has a conical tapered internal shape, which is $\alpha°$ in apical angle, $\Phi D$ in inlet diameter, and $\Phi d_2$ in outlet diameter. The central axis 37 of the front-stage first pore 35 and the central axis 38 of the rear-stage first pore 36 are eccentrically positioned with an axial offset=X. The axial offset cited herein refers to a distance between the axial center of the front-stage first pore 35 and the axial center of the rear-stage first pore 36.

Gas containing ions 7 and droplets 8 from under atmospheric pressure is first introduced along the central axis 37 of the front-stage first pore 35 as indicated by line 39. The introduced gas containing ions 7 and droplets 8 collides with the internal surface of the intermediate pressure chamber 33 at a collision point 40. $\beta°$ is taken as an incident angle at the time of collision. When the central axis 37 of the front-stage first pore 35 and the taper center of the intermediate pressure chamber 33 are parallel to each other, a relation of $\beta=\alpha/2$ holds. It assumed that ions travel along the axial direction of the front-stage first pore. At this time, the angle formed between the axial direction of the front-stage first pore and the wall surface of the intermediate pressure chamber is set as $\beta$. The central axis 37 of the front-stage first pore 35 and the taper center of the intermediate pressure chamber 33 need not necessarily be parallel to each other. After collision, an air flow changes the direction thereof and travels along the internal surface angle of the intermediate pressure chamber 33 as indicated by line 41. The air flow thereafter changes the direction thereof again in proximity to an inlet of the rear-stage first pore 36 and travels along the central axis 38 of the rear-stage first pore 36 as indicated by line 42, being then introduced into the first vacuum chamber 13.

At this time, an important thing is that when the air flow passes through the ion introduction electrode 12, the cross-sectional area of the flow path discontinuously changes. Specifically, during proceeding from the front-stage first pore 35 to the intermediate pressure chamber 33, the cross-sectional area is rapidly increased and thus the air flow can become turbulent. When the velocity of the air flow from the front-stage first pore 35 is brought into a sound velocity state, a turbulent flow is prone to occur in proximity to an outlet of the front-stage first pore 35. When $P_o$ (=atmospheric pressure) is taken as the primary-side pressure of the front-stage first pore 35 and $P_M$ is taken for the secondary-side pressure, it is desirable that a condition of $P_M/P_o \leq 0.5$, which is a sound velocity condition, should be established to obtain a turbulent flow. The primary-side pressure cited herein refers to a pressure in proximity to an inlet of the front-stage first pore 35 and the secondary-side pressure refers to a pressure at an outlet to the intermediate pressure chamber 33. Since a turbulent flow occurs, small-diameter ions 7 and the like low in inertia travel along a flow going downstream while large-diameter droplets 8 and the like high in inertia cannot make a turn and collide with the collision point 40. This enables prevention of inflow of droplets to the downstream area. Ordinary intra-pipe flow constant in inside diameter (≈laminar flow) is more accelerated with proximity to the pipe center because of the influence of pipe friction and is significantly decelerated in proximity to a pipe inner wall. For this reason, there is a possibility that a noise factor such as droplets also flows out of an outlet of the rear-stage first pore 36 along a strong flow in proximity to the pipe center. That is, even when an intra-pipe flow path is cranked, droplets and the like less possibly collide with the pipe interior.

Another important thing is the intermediate pressure chamber 33 in such a taper shape that the cross-sectional area of the interior thereof is continuously reduced as it goes along the traveling direction of ions. That the cross-sectional area of the interior is continuously reduced means that a flow velocity is gradually increased. An air flow becomes turbulent and uncontrollable once in proximity to an inlet of the intermediate pressure chamber 33. However, by adopting such a shape of the intermediate pressure chamber 33 that there is a velocity distribution along a traveling direction like a taper shape, an air flow can be forcedly produced on the downstream side.

A further another important thing is that there is not an outlet in the intermediate pressure chamber 33 other than the rear-stage first pore 36 and thus ions 7 introduced into the intermediate pressure chamber 33 can pass therethrough without a loss.

In FIG. 2(B), a front-stage member 32 and a rear-stage member 34 are depicted as separate members but these members may be a single member. However, it is desirable that these members should be formed of two structures as shown in FIG. 2(B) in terms of manufacturing costs of parts and the like. Further, the intermediate pressure chamber 33 and the rear-stage first pore 36 may be formed of separate members. Further, the front-stage first pore 35 and the intermediate pressure chamber 33 may be formed of a single member and only the rear-stage first pore 36 may be formed of a separate member.

A description will be given to results of performance comparisons conducted using ion introduction electrodes shown in FIGS. 3(A) and 3(B) and FIGS. 4(A) and 4(B) and an ion introduction electrode 12 in this example. The ion introduction electrode 12 in this example and the ion introduction electrodes shown in FIGS. 3(A) and 3(B) and FIGS. 4(A) and 4(B) are fundamentally differently configured; but in the following description, the same reference numerals and the like as in this example will be used for similar elements for simplification of comparison. The description of configuration elements and functions overlapped with those described with reference to FIGS. 2(A) and 2(B) will be omitted for the sake of simplification.

Figure 2:
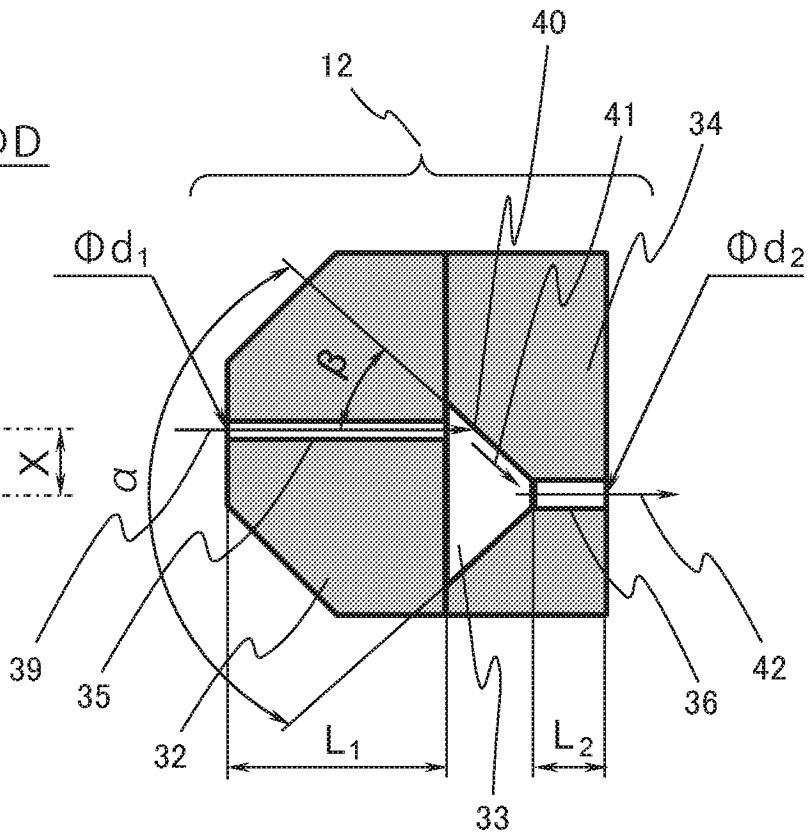
FIG. 2(A) is an explanatory drawing of an ion introduction electrode in the first example as viewed from the direction of an ion source.
FIG. 2(B) is an explanatory drawing of a section of an ion introduction electrode in the first example taken along the central axis thereof.
Figure 2:
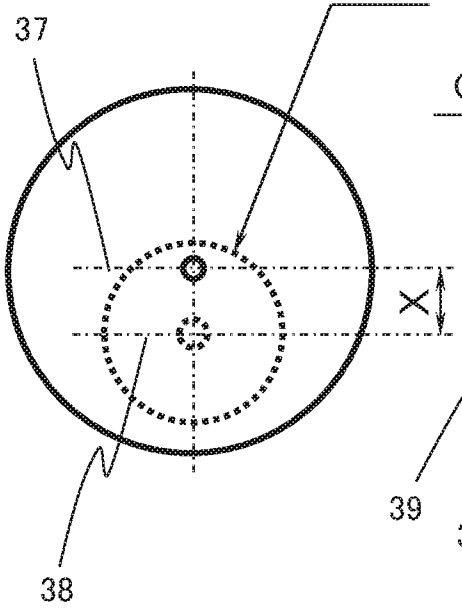
Figure 3:
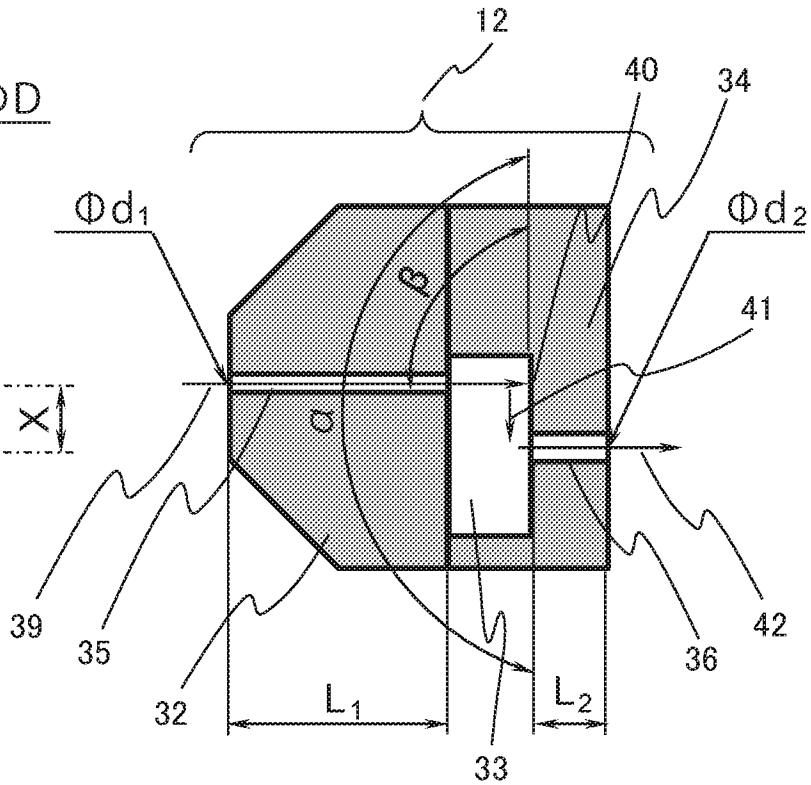
FIG. 3(A) is an explanatory drawing of an ion introduction electrode used for performance comparison with an ion introduction electrode in the first example as viewed from the direction of an ion source.
FIG. 3(B) is an explanatory drawing of a section of an ion introduction electrode used for performance comparison with an ion introduction electrode in the first example taken along the central axis thereof.
Figure 3:
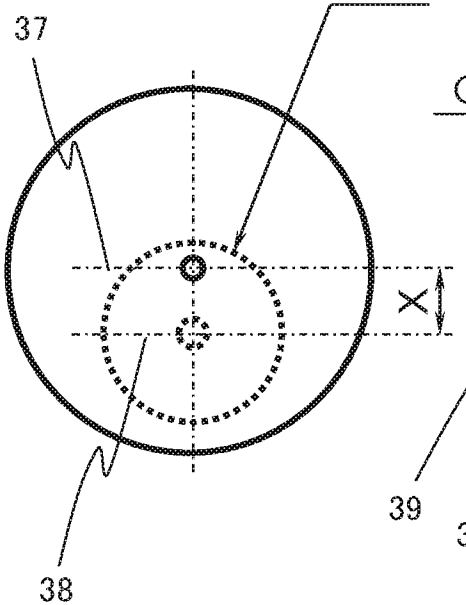
Figure 4:
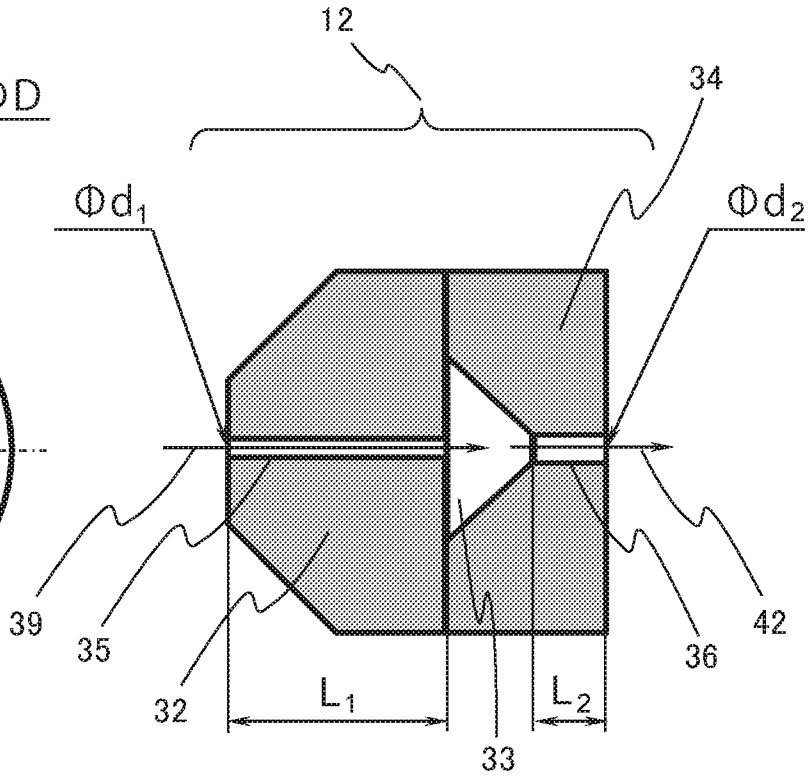
FIG. 4(A) is an explanatory drawing of an ion introduction electrode used for performance comparison with an ion introduction electrode in the first example as viewed from the direction of an ion source.
FIG. 4(B) is an explanatory drawing of an ion introduction electrode used for performance comparison with an ion introduction electrode in the first example taken along the central axis thereof.
Figure 4:
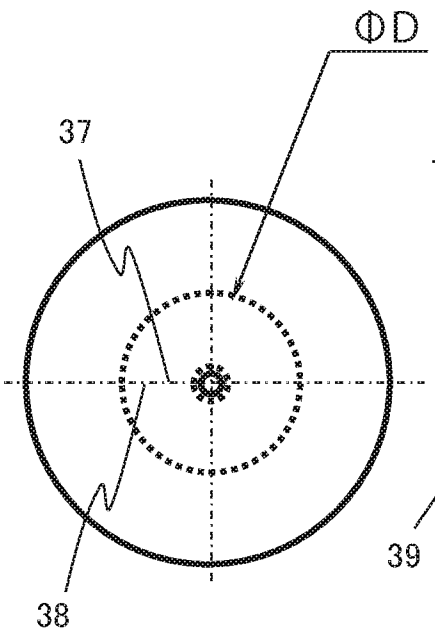
Figure 5:
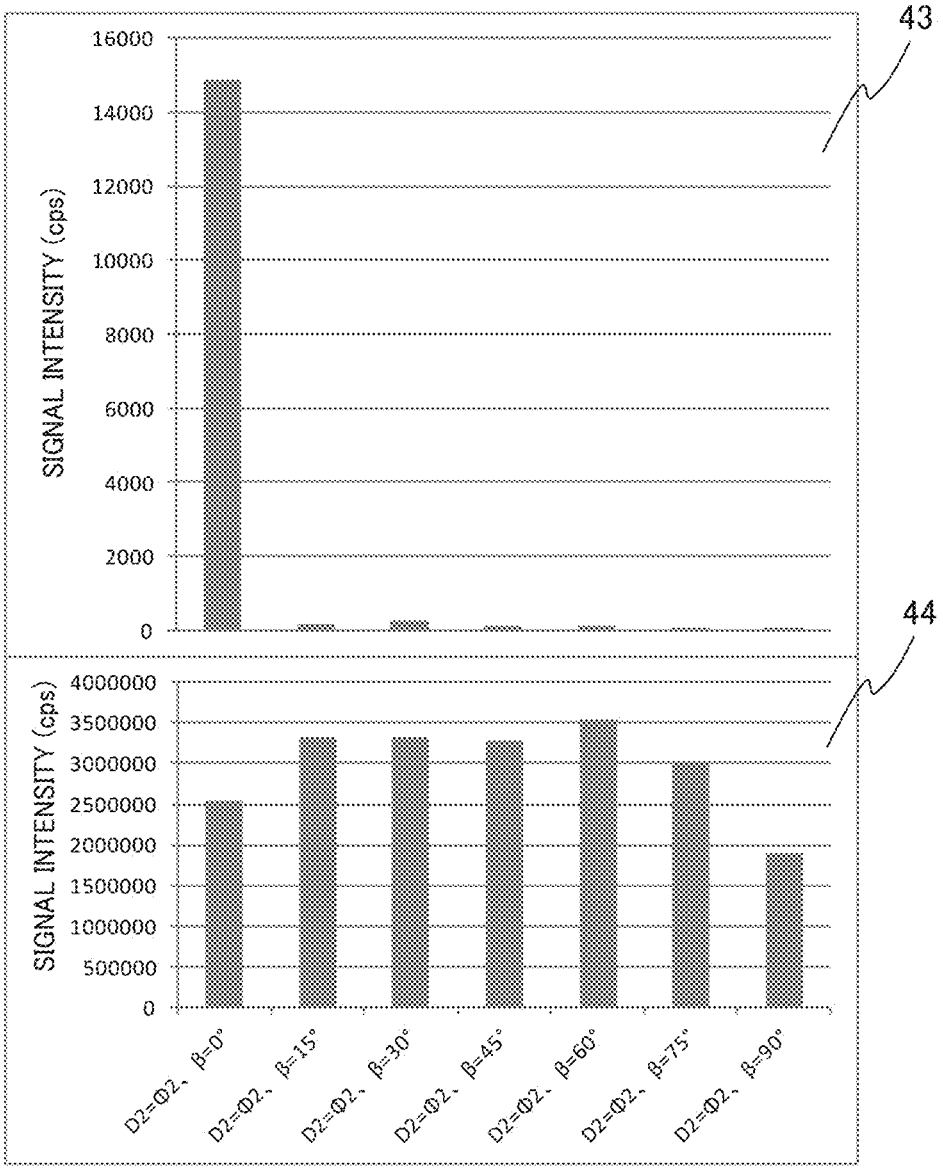
FIG. 5 is an explanatory drawing indicating results with respect to droplet noise intensity and ion intensity depending on the angle of ion incidence to an intermediate pressure chamber in the first example.

FIGS. 3(A) and 3(B) illustrate a configuration in which an incident angle β=90° at the time of collision, that is, collision occurs at a right angle. Meanwhile, FIGS. 4(A) and 4(B) illustrate a configuration in which an axial offset X=0 mm (central axis 37=central axis 38), that is, there is not a collision point 40 or a line 41 indicating a changed direction (Though there is not collision, this will be hereafter expressed as incident angle β=0° configuration for the sake of convenience). FIG. 5 indicates results of comparison of FIG. 2(B) (β=15°, 30°, 45°, 60°, 75°) with FIG. 3(B) (β=90° and FIG. 4(B) (β=0°. The upper part of FIG. 5 indicates a droplet noise intensity result 43 and the lower part thereof indicates an ion intensity (reserpine ions: m/z609) result 44. The configurations in FIG. 2(A) and FIG. 3(A) were all set to an axial offset X=3 mm. Other conditions were: $d_1$=Φ0.65 mm, $L_1$=20 mm, $d_2$=Φ2 mm, $L_2$=6 mm. It can be seen from the droplet noise intensity result 43 that with other configurations than the configuration shown in FIG. 4(B), in which the axial offset X=0 mm, droplet noise intensity can be reduced to 1/100 or less. This verifies the effectiveness of this example. Meanwhile, the ion intensity results 44 indicates that all the configurations including a taper shape shown in FIG. 2(B) obtain higher intensity than those shown in FIG. 3(B) and FIG. 4(B). The reason of this is an effect of the intermediate pressure chamber 33 having a velocity distribution specific to taper shapes as described up to this point. With such a right-angled structure in which β=90° as shown in FIG. 3(B), a rate vector toward the downstream area which is the traveling direction of air flows does not exist in the intermediate pressure chamber. As a result, the amount drawn in only by a flow velocity locally accelerated in proximity to an inlet of the rear-stage first pore is equivalent to an amount of introduction and this degrades sensitivity. With the configuration of X=0 mm shown in FIG. 4(B), the central axis 37 of the front-stage first pore 35 and the central axis 38 of the rear-stage first pore 36 are coaxial with each other and $d_1 \leq d_2$. Therefore, a near-sound velocity jet stream in proximity to an outlet of the front-stage first pore 35 goes through the rear-stage first pore 36 and is introduced directly into the first vacuum chamber 13. For this reason, ion transmission efficiency in a rear stage is degraded by turbulence of a flow. Therefore, it can be concluded that at least an incident angle β=15 to 75° is a favorable condition.

Figure 6:
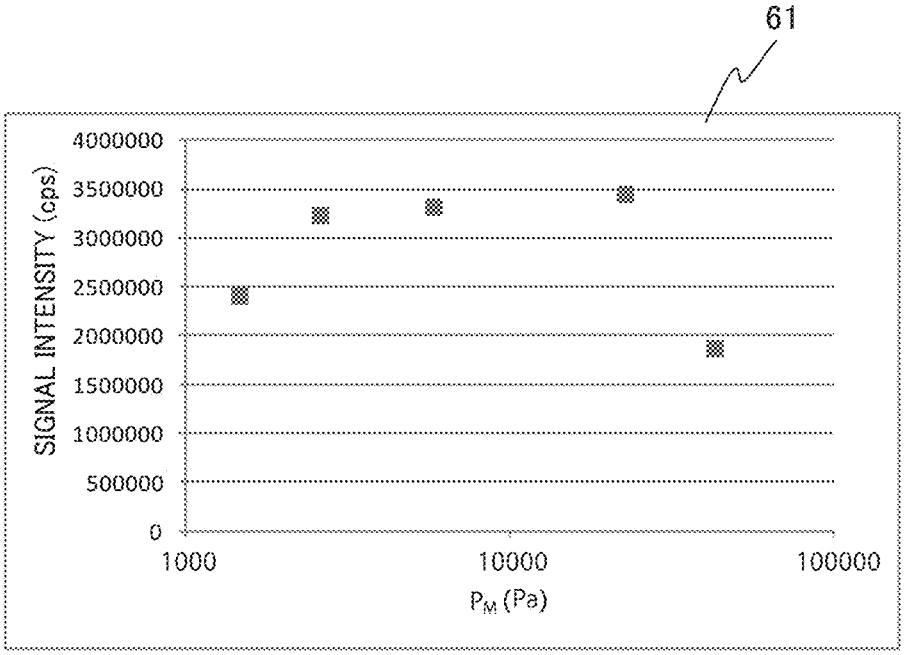
FIG. 6 is an explanatory drawing indicating results with respect to ion intensity depending on the pressure in an intermediate pressure chamber in the first example.

A description will be given to a result of ion intensity comparison with the configuration of an incident angle β=30° depending on the internal pressure of the intermediate pressure chamber 33 with reference to FIG. 6. FIG. 6 indicates an internal pressure ($P_M$) dependence result 61 with the intermediate pressure chamber 33 with respect to ion intensity (reserpine ions: m/z609). The values of $P_M$ are obtained by converting conditions such as $d_1$, $L_1$, $d_2$, $L_2$ and the pressure of the first vacuum chamber 13=$P_1$ using Formula 1 below. Here, $P_0$=atmospheric pressure ($10^5$ Pa).

$$P_M=((d_1^4\times P_0^2/L^1+d_2^4\times P_1^2/L_2)/(d_1^4/L_1+d_2^4/L_2))^{1/2} \quad \text{(Formula 1)}$$

It can be concluded from FIG. 6 that a range of 2000 to 30000 Pa or so is optimal. This optimal pressure condition is half or less of the inlet-side pressure ($10^5$ Pa) of the front-stage first pore 35. Therefore, a sound velocity state is established in proximity to an outlet of the front-stage first pore 35 and a Mach disk can be formed there. The distance $M_L$ from an outlet of the front-stage first pore 35 to the Mach disk can be expressed by Formula 2 below.

$$M_L=0.67\times P_O/P_M)^{1/2}\times d_1 \quad \text{(Formula 2)}$$

From Formula 2, $M_L$ is 0.8 to 3 mm under the condition of $d_1$=Φ0.65. From Formula 3, the diameter $M_D$ of the Mach disk in the position of $M_L$ can be 1.5 mm or so at the maximum.

$$M_D=0.4 \text{ to } 0.5\times M_L \quad \text{(Formula 3)}$$

According to this result, spraying can occur within the maximum diameter 1.5 mm (radius: 0.75 mm) in proximity to the collision point 40 on the inner wall of the intermediate pressure chamber 33. Therefore, unless an axial offset X is set to $X \geq M_D/2+d_2/2$, there is a danger than an outlet jet of the front-stage first pore 35 is sprayed directly to the rear-stage first pore 36. Specifically, it is required to adopt an arrangement of X≥1.75 mm under the conditions of $d_1$=Φ0.65 mm and $d_2$=Φ2 mm. Similarly, unless the taper inlet diameter ΦD of the intermediate pressure chamber 33 is set to $\Phi D \geq 2\times(X+M_D/2)$, an introduction loss occurs at the taper inlet. Specifically, it is required to adopt an arrangement of ΦD≥Φ4 mm (taper inlet area≥12 $mm^2$) under the conditions of $d_1$=Φ0.65 mm and $d_2$=Φ2 mm. It is desirable that these values should be set to X≥1.5 mm and a taper inlet area≥12 $mm^2$ or so depending on the dimensions of $d_1$ and $d_2$.

A jet stream that is in a sound velocity state at an outlet of the front-stage first pore 35 is advantageous to this example. In this example, as mentioned above, droplets are removed by utilizing turbulence of a flow at an inlet of the intermediate pressure chamber 33 and the effect of ion permeability enhancement is brought about by taper shape. The interior of the intermediate pressure chamber 33 is as low as 2000 to 30000 Pa as compared with atmospheric pressure. This reduces a pressure difference between an inlet and an outlet of the rear-stage first pore 36; as a result, turbulence of a flow is more mitigated than with ordinary configurations only with a first pore electrode and ion transmission efficiency in a rear stage is enhanced.

Figure 7:
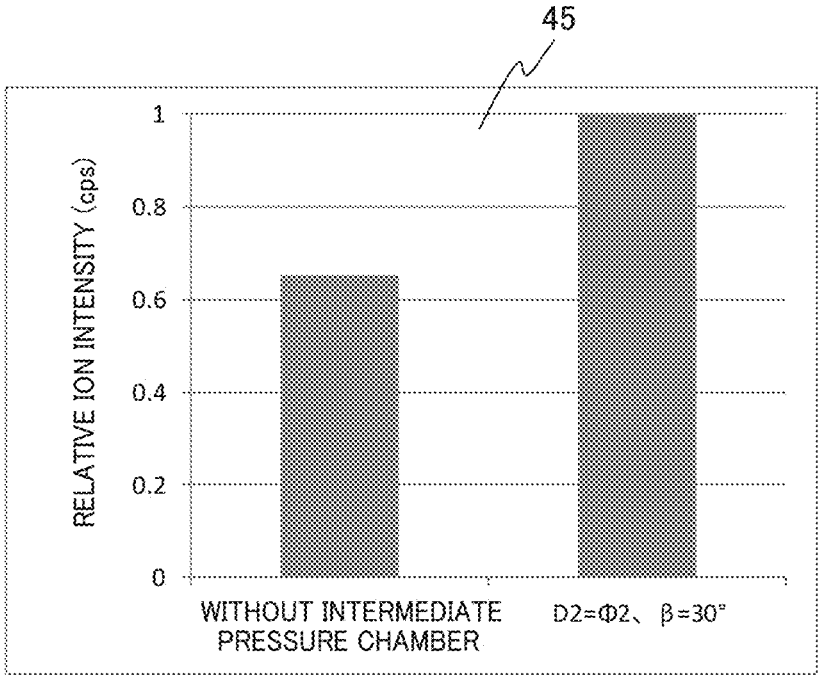
FIG. 7 is an explanatory drawing illustrating an effect of an intermediate pressure chamber in the first example.

A description will be given to a result of performance comparison of an ordinary equipment configuration without the intermediate pressure chamber 33 and the rear-stage first pore 36 with the configuration of this example (FIG. 2(B)) with reference to FIG. 7. FIG. 7 indicates a comparison result 45 with respect to the presence or absence of the intermediate pressure chamber. It can be seen from FIG. 7 that with the configuration without the intermediate pressure chamber 33, ion intensity (reserpine ions: m/z609) is reduced to 70% or less of that with the configuration with the intermediate pressure chamber. This result indicates the following as described above: a pressure difference between an inlet and an outlet of the rear-stage first pore 36 is reduced by the intermediate pressure chamber 33 and the rear-stage first pore 36; for this reason, a flow velocity at an outlet of the rear-stage first pore 36 is made lower than with the ordinary equipment configuration and a loss in ion transmission due to turbulence of a flow is reduced. This evaluation was conducted with the configuration of: $d_1$=Φ0.65 mm, $L_1$=20 mm, $d_2$=Φ2 mm, $L_2$=6 mm, β=30°, and X=3 mm.

Figure 8:
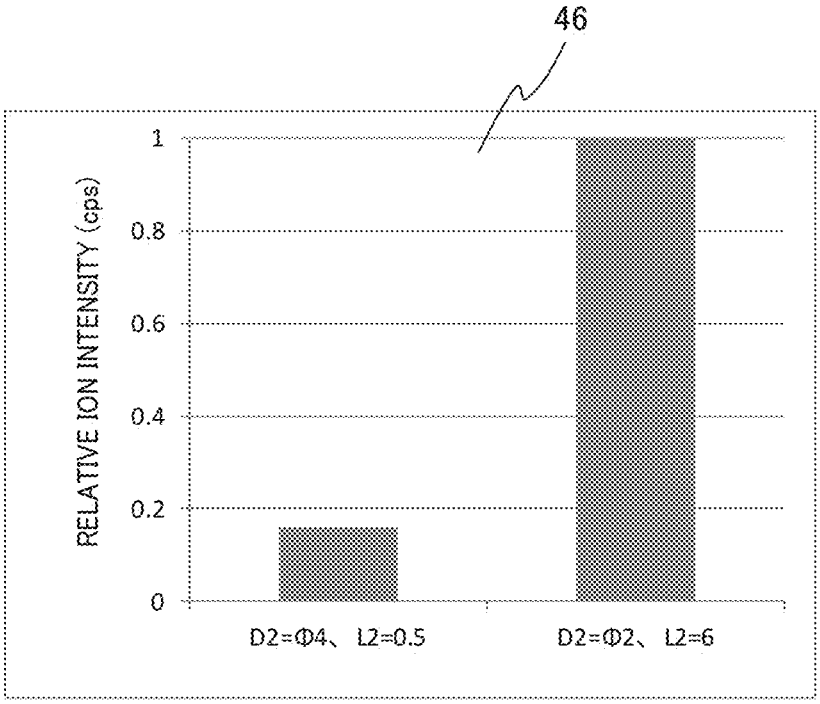
FIG. 8 is an explanatory drawing indicating a result of performance comparison depending on the inside diameter and length of a rear-stage first pore in the first example.

A description will be given to a result of performance comparison depending on the diameter $d_2$ and length $L_2$ of the rear-stage first pore 36 with reference to FIG. 8. FIG. 8 indicates a comparison result 46 with respect to the structure of the rear-stage first pore. It can be seen from FIG. 8 that with the configuration of $d_2$=Φ4 mm and length $L_2$=0.5 mm, ion intensity (reserpine ions: m/z609) is reduced to ⅕ or below of that with the configuration of $d_2$=Φ2 mm and length $L_2$=6 mm.

Figure 9:
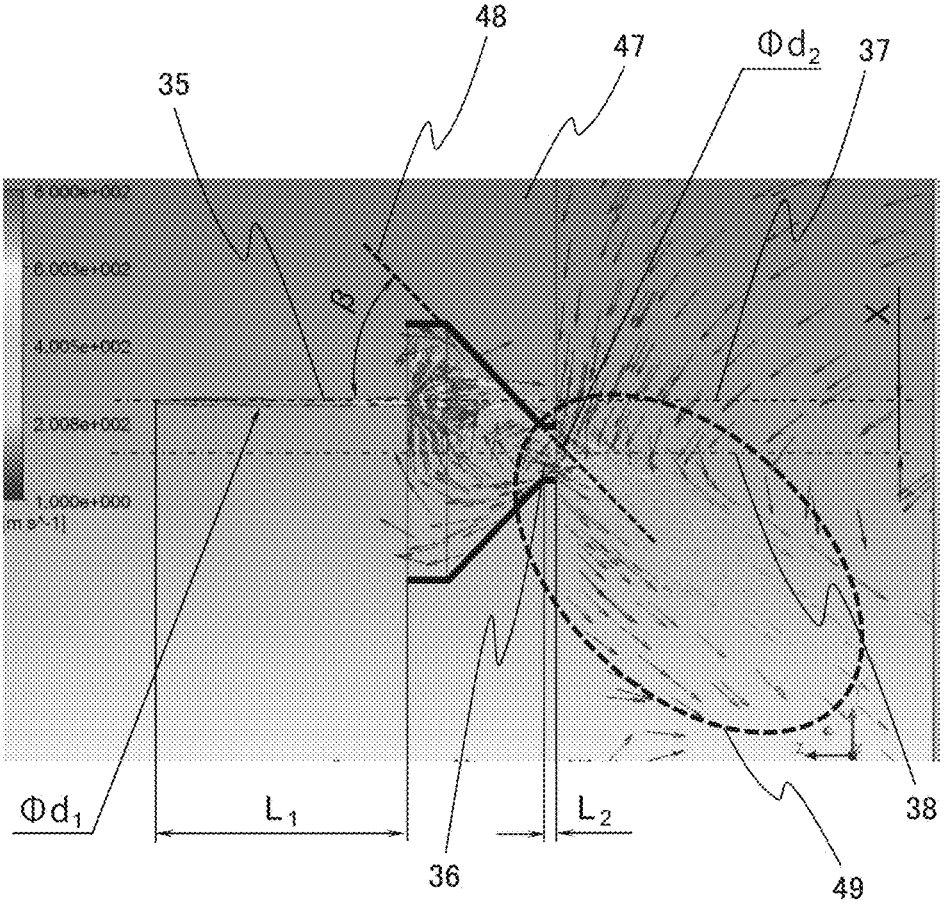
FIG. 9 is an explanatory drawing indicating a result of a fluid simulation with an ion introduction electrode used for performance comparison with an ion introduction electrode in the first example.

FIG. 9 indicates a fluid simulation result 47 with the configuration of $d_2$=Φ4 mm and length $L_2$=0.5 mm conducted to verify the above result. The many arrows in FIG. 9 indicate the directions of fluid flows. It can be seen from FIG. 9 that many arrows are plotted along an extension line 48 of a taper angle of the intermediate pressure chamber 33. In particular, there are very many arrows in the direction of the extension line 48 within the range 49, encircled with a dotted line, sprayed from the rear-stage first pore 36. Also in an actual experimental system, like this flow, spraying was obliquely carried out with respect to the central axis 38 of the rear-stage first pore 36. It is suspected that ion transmission efficiency in a rear stage is markedly degraded for this reason.

Figure 10:
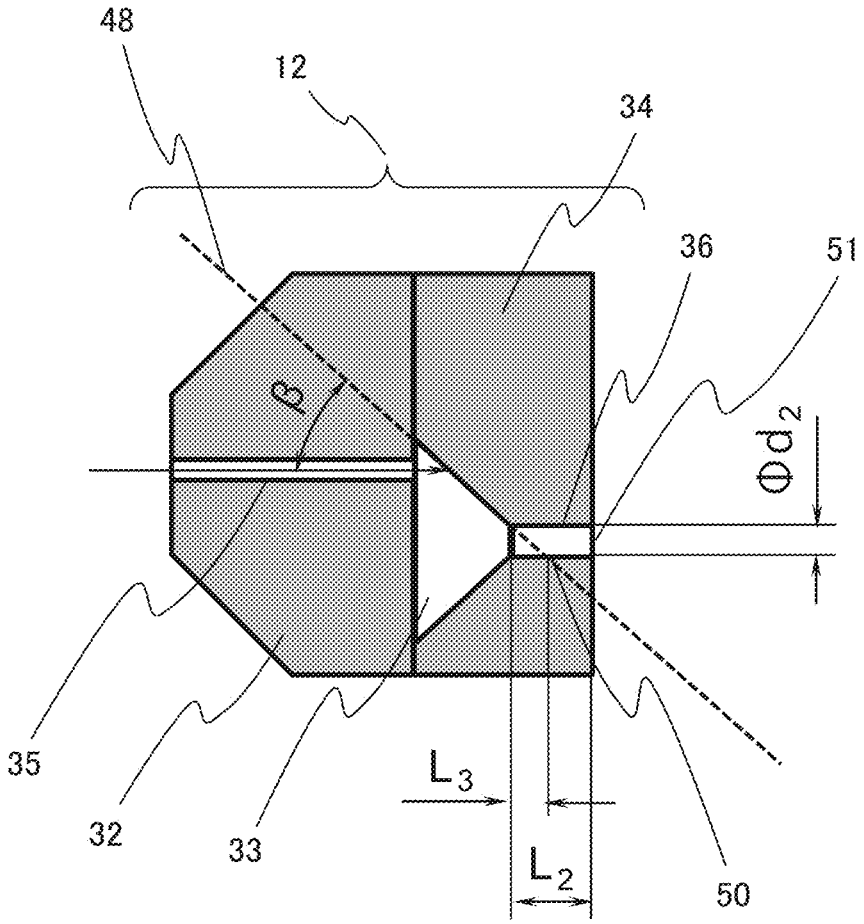
FIG. 10 is an explanatory drawing illustrating relation between the inside diameter and the length of a rear-stage first pore in the first example.

Based on these results, a description will be given to an optimum configuration with reference to FIG. 10. To avoid the fluid simulation result in FIG. 9, it is required to take the measure illustrated in FIG. 10. That is, it is required that the extension line 48 of a taper angle of the intermediate pressure chamber 33 and the inner wall of the rear-stage first pore 36 intersect with each other (at a cross point 50). That is, an outlet end 51 of the rear-stage first pore 36 must be located on the downstream side with the extension line 48 in between. Specifically, the position $L_3$ of the cross point 50 is expressed by Formula 4.

$$L_3=d_2\times\tan(90-\beta) \quad \text{(Formula 4)}$$

When the condition of β=15 to 75° taken as optimum in FIG. 5 is substituted, $L_3/d_2$=0.3 to 3.7. That is, it is required to establish a condition of $L_3/d_2 \geq 0.3$ depending on the taper angle.

In the second to 11th examples described later, when the angle of the wall surface of the intermediate pressure chamber differs between the ion inlet side and the outlet side, an optimum angle only has to be selected for β. To do this, an average value may be taken as an optimum angle or an optimum angle may be calculated using an angle on the rear-stage pore 36.

Example 2

In relation to a second example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the second example is characterized in that the second example has: such a taper shape that the cross-sectional area of the interior thereof is continuously reduced as it goes along the traveling direction of ions; and an intermediate pressure chamber including a straight cylindrical portion.

Figure 11A:
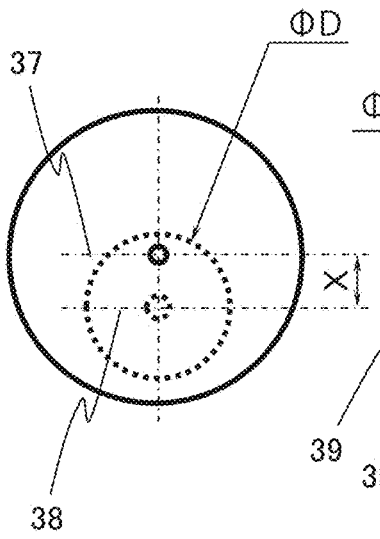
FIG. 11(A) is an explanatory drawing of an ion introduction electrode in a second example as viewed from the direction of an ion source.
Figure 11B:
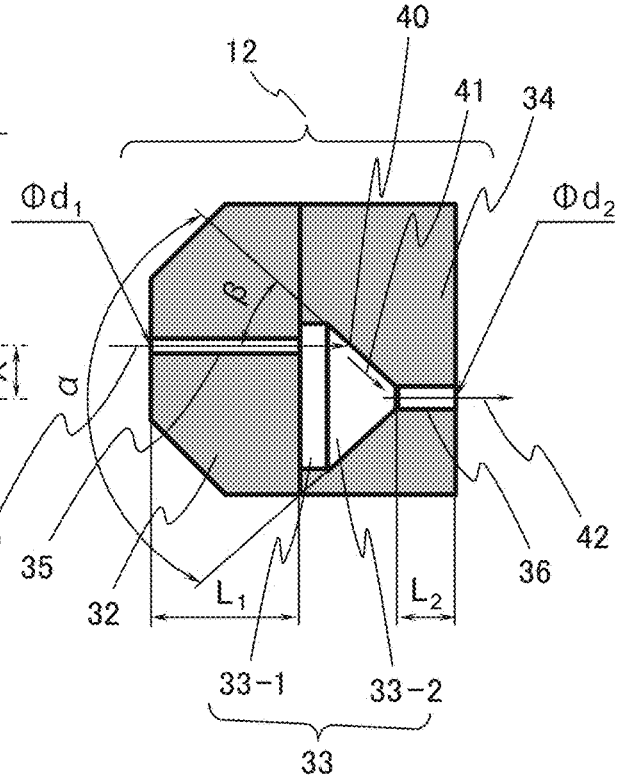
FIG. 11(B) is an explanatory drawing of a section of an ion introduction electrode in the second example taken along the central axis thereof.

A detailed description will be given to a configuration of an ion introduction electrode 12 in the second example with reference to FIGS. 11(A) and 11(B). FIG. 11(A) illustrates the ion introduction electrode 12 as viewed from the direction of an ion source 2; and FIG. 11(B) is a cross-sectional view of the ion introduction electrode 12 taken along the central axis thereof. The ion introduction electrode 12 shown in FIG. 11(B) is basically substantially identical with the ion introduction electrode 12 described with reference to FIG. 2(B) in configuration and function. Therefore, a redundant description will be omitted and only a difference from the configuration shown in FIG. 2(B) will be described. In the ion introduction electrode 12 shown in FIG. 11(B), the intermediate pressure chamber 33 is composed of a front-stage portion 33-1 and a rear-stage portion 33-2. Like the intermediate pressure chamber 33 described with reference to FIG. 2(B), the rear-stage portion 33-2 is in such a taper shape that the cross-sectional area of the interior thereof is continuously reduced as it goes along the traveling direction of ions. In contrast with this, the front-stage portion 33-1 is in a straight cylindrical shape and the cross-sectional area thereof is unchanged. In the structure of the intermediate pressure chamber 33 shown in FIG. 11(B), at least a part thereof is provided with such a taper shape that the cross-sectional area of the interior thereof is continuously reduced as it goes along the traveling direction of ions. As a result, the same functions as described with reference to FIGS. 2(A) and 2(B) can be basically obtained. Provision of the front-stage portion 33-1 enables the distance from an outlet of the front-stage first pore 35 to the collision point 40 to be lengthened. This is the case even when the taper center inlet diameter ΦD and the incident angle β are identical with those in the first example. This brings about an advantage that contamination due to a rebound from collision can be reduced in proximity to an outlet of the front-stage first pore 35.

Like the ion introduction electrode 12 shown in FIG. 2(B), the ion introduction electrode 12 in FIG. 11(B) can also be combined with the equipment configuration described with reference to FIG. 1.

Example 3

In relation to a third example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the third example is characterized in that the intermediate pressure chamber has such a taper shape having two different angles that the cross-sectional area of the interior thereof is continuously reduced as it goes along the traveling direction of ions.

Figure 12:
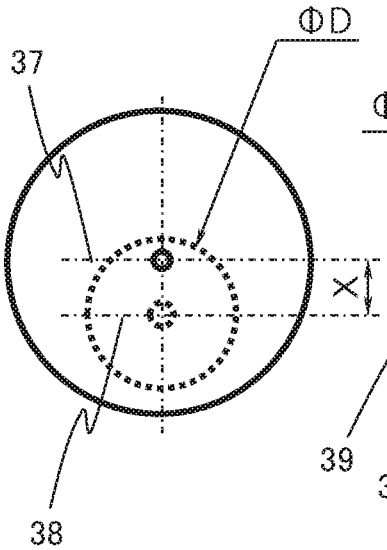
FIG. 12(A) is an explanatory drawing of an ion introduction electrode in a third example as viewed from the direction of an ion source.
FIG. 12(B) is an explanatory drawing of a section of an ion introduction electrode in the third example taken along the central axis thereof.
Figure 12:
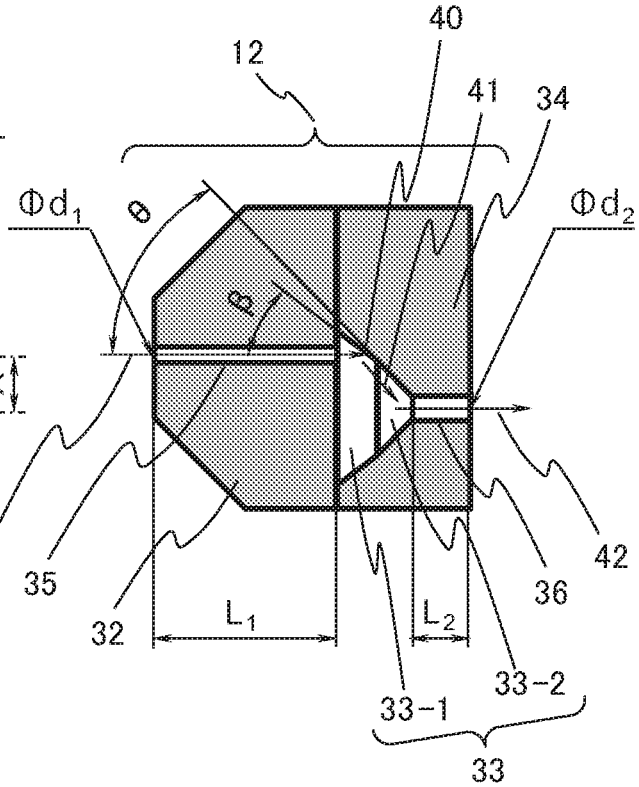

A detailed description will be given to a configuration of an ion introduction electrode 12 in the third example with reference to FIGS. 12(A) and 12(B). FIG. 12(A) illustrates the ion introduction electrode 12 as viewed from the direction of an ion source 2; and FIG. 12(B) is a cross-sectional view of the ion introduction electrode 12 taken along the central axis thereof. The ion introduction electrode 12 shown in FIG. 12(B) is basically substantially identical with the ion introduction electrode 12 described with reference to FIG. 2(B) in configuration and function. Therefore, a redundant description will be omitted and only a difference from the configuration shown in FIG. 2(B) will be described. In the ion introduction electrode 12 shown in FIG. 12, the intermediate pressure chamber 33 is composed of a front-stage portion 33-1 and a rear-stage portion 33-2. Like the intermediate pressure chamber 33 described with reference to FIG. 2(B), the front-stage portion 33-1 and the rear-stage portion 33-2 are also in such a taper shape that the cross-sectional area of the interior thereof is continuously reduced as it goes along the traveling direction of ions. However, the front-stage portion 33-1 and the rear-stage portion 33-2 are different from each other in taper angle. The taper of the front-stage portion 33-1 has an incident angle β. The taper of the rear-stage portion 33-2 is at an angle θ corresponding to β, where $\beta<\theta$. In this example, like the structure of the intermediate pressure chamber 33 shown in FIG. 12(B), each of the tapers having two different angles is in such a shape that the cross-sectional area of the interior thereof is continuously reduced as it goes along the traveling direction of ions. Even with these taper shapes, the same functions as described with reference to FIG. 2(B) can be obtained. Since the angle θ of the rear-stage portion 33-2 is larger than the angle β of the front-stage portion 33-1, an advantage is brought about. After collision at the collision point 40 in the front-stage portion 33-1, a quantity of droplets introduced into the rear-stage first pore 36 can be reduced. In the example shown in FIG. 12(B), the intermediate pressure chamber 33 has two different taper angles. Even in an intermediate pressure chamber 33 in a multi-staged taper shape having more than two taper angles, the same effects can be obtained.

Like the ion introduction electrode 12 shown in FIG. 2(B), the ion introduction electrode 12 in FIG. 12(B) can also be combined with the equipment configuration described with reference to FIG. 1.

Example 4

In relation to a fourth example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the fourth example is characterized in that the intermediate pressure chamber in such a shape that the cross-sectional area of the interior thereof is continuously reduced as it goes along the traveling direction of ions is configured as follows: unlike tapers, the cross-sectional shape thereof is not linearly changed but is curvilinearly changed. Therefore, the intermediate pressure chamber in the fourth example has a bowl-like internal shape. This intermediate pressure chamber is similar in structure to what is obtained by infinitely increasing a number of stages of the intermediate pressure chamber in the third example having a multi-staged taper shape including multiple taper angles.

Figure 13:
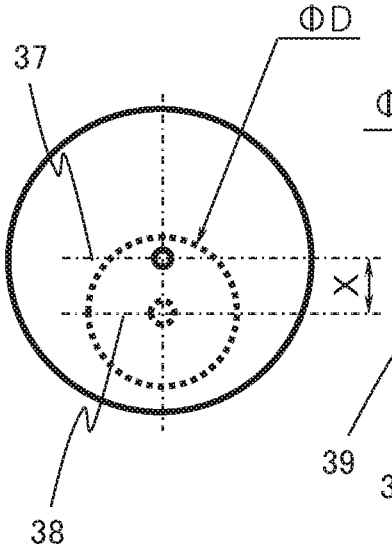
FIG. 13(A) is an explanatory drawing of an ion introduction electrode in a fourth example as viewed from the direction of an ion source.
FIG. 13(B) is an explanatory drawing of a section of an ion introduction electrode in the fourth example taken along the central axis thereof.
Figure 13:
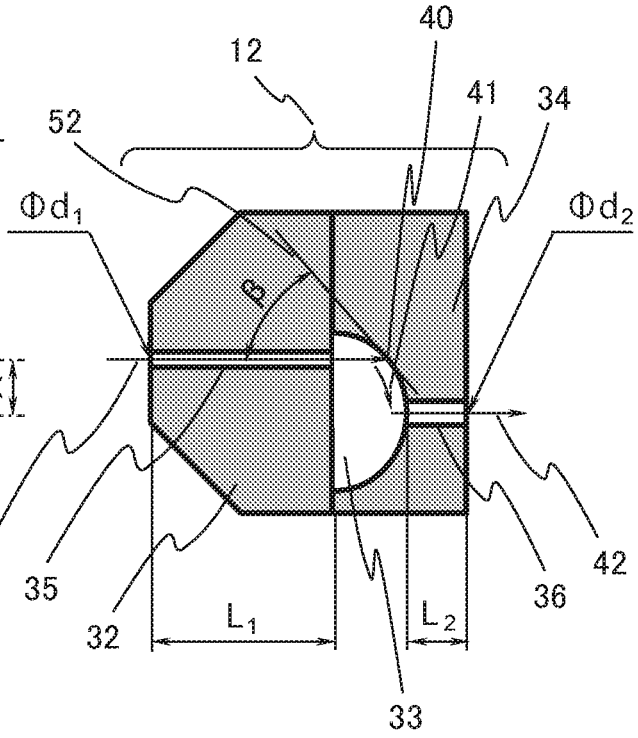

A detailed description will be given to a configuration of an ion introduction electrode 12 in the fourth example with reference to FIGS. 13(A) and 13(B). FIG. 13(A) illustrates the ion introduction electrode 12 as viewed from the direction of an ion source 2; and FIG. 13(B) is a cross-sectional view of the ion introduction electrode 12 taken along the central axis thereof. The ion introduction electrode 12 shown in FIG. 13(B) is basically substantially identical with the ion introduction electrode 12 described with reference to FIG. 2(B) in configuration and function. Therefore, a redundant description will be omitted and only a difference from the configuration shown in FIG. 2(B) will be described. In the ion introduction electrode 12 shown in FIG. 13(B), the intermediate pressure chamber 33 is in such a shape (bowl shape) that the cross-sectional shape thereof is not linearly changed like tapers but is curvilinearly changed. In the case of this configuration, an incident angle β is formed by a curved tangential line 52 at a section at a collision point 40. The intermediate pressure chamber 33 in FIG. 13(B) is also in such a shape that the cross-sectional area of the interior thereof is continuously reduced as it goes along the traveling direction of ions; therefore, the same effects as described with reference to FIG. 2(B) can be basically obtained. Since the tangential angle of a section of the intermediate pressure chamber 33 is continuously and gently changed with traveling of ions, ions can be introduced into the rear-stage first pore 36 with a less loss.

Like the ion introduction electrode 12 shown in FIG. 2(B), the ion introduction electrode 12 in FIG. 13(B) can also be combined with the equipment configuration described with reference to FIG. 1.

Example 5

In relation to a fifth example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the fifth example is characterized in that the intermediate pressure chamber has such a taper shape having two different angles that the cross-sectional area of the interior thereof is continuously reduced as it goes along the traveling direction of ions.

Figure 14:
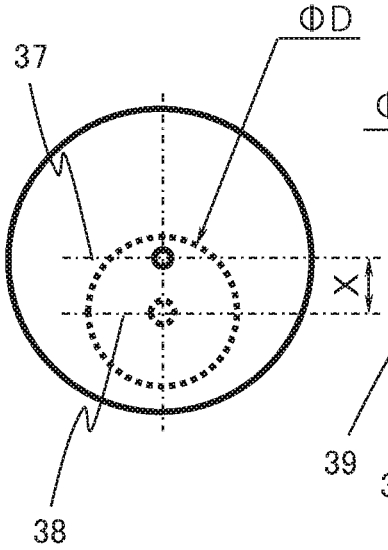
FIG. 14(A) is an explanatory drawing of an ion introduction electrode in a fifth example as viewed from the direction of an ion source.
FIG. 14(B) is an explanatory drawing of a section of an ion introduction electrode in the fifth example taken along the central axis thereof.
Figure 14:
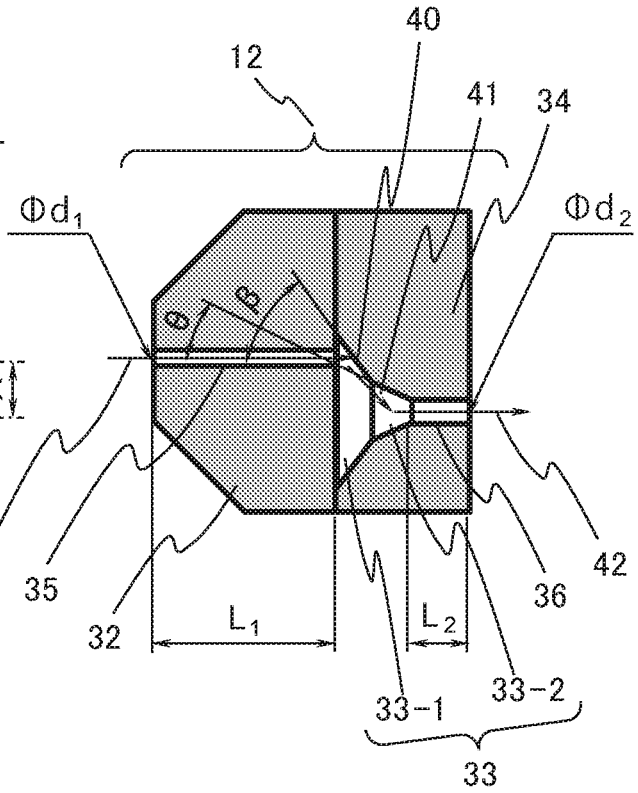

A detailed description will be given to a configuration of an ion introduction electrode 12 in the fifth example with reference to FIGS. 14(A) and 14(B). FIG. 14(A) illustrates the ion introduction electrode 12 as viewed from the direction of an ion source 2; and FIG. 14(B) is a cross-sectional view of the ion introduction electrode 12 taken along the central axis thereof. The ion introduction electrode 12 shown in FIG. 14(B) is basically substantially identical with the ion introduction electrode 12 described with reference to FIG. 2(B) in configuration and function. Therefore, a redundant description will be omitted and only a difference from the configuration shown in FIG. 2(B) will be described. In the ion introduction electrode 12 shown in FIG. 14(B), the intermediate pressure chamber 33 is composed of a front-stage portion 33-1 and a rear-stage portion 33-2. Like the intermediate pressure chamber 33 described with reference to FIG. 2(B), the front-stage portion 33-1 and the rear-stage portion 33-2 are also in such a taper shape that the cross-sectional area of the interior thereof is continuously reduced as it goes along the traveling direction of ions. However, the front-stage portion 33-1 and the rear-stage portion 33-2 are different from each other in taper angle. The taper of the front-stage portion 33-1 has an incident angle $\beta$. The taper of the rear-stage portion 33-2 is at an angle $\theta$ corresponding to $\beta$, where $\beta>\theta$. In this example, like the structure of the intermediate pressure chamber 33 shown in FIG. 14(B), each of the tapers having two different angles is in such a shape that the cross-sectional area of the interior thereof is continuously reduced as it goes along the traveling direction of ions. Even with these taper shapes, the same functions as described with reference to FIG. 2(B) can be basically obtained. Since the angle $\beta$ of the front-stage portion 33-1 is larger than the angle $\theta$ of the rear-stage portion 33-2, an advantage is brought about. After collision at the collision point 40 in the front-stage portion 33-1, a loss in a quantity of ions introduced into the rear-stage first pore 36 can be prevented. In the example shown in FIG. 14(B), the intermediate pressure chamber 33 has two different taper angles. Even in an intermediate pressure chamber 33 in a multi-staged taper shape having more than two taper angles, the same effects can be obtained.

Like the ion introduction electrode 12 shown in FIG. 2(B), the ion introduction electrode 12 in FIG. 14(B) can also be combined with the equipment configuration described with reference to FIG. 1.

Example 6

In relation to a sixth example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the sixth example is characterized in that the intermediate pressure chamber in such a shape that the cross-sectional area of the interior thereof is continuously reduced as it goes along the traveling direction of ions is configured as follows: unlike tapers, the cross-sectional shape thereof is not linearly changed but is curvilinearly changed. Therefore, the intermediate pressure chamber in the sixth example has a trumpet-like internal shape. This intermediate pressure chamber is similar in structure to what is obtained by infinitely increasing a number of stages of the intermediate pressure chamber in the fifth example having a multi-staged taper shape including multiple taper angles.

Figure 15:
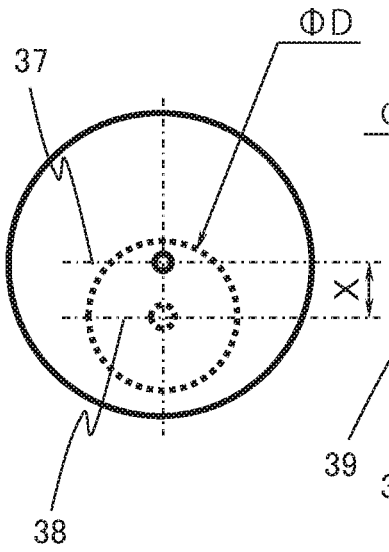
FIG. 15(A) is an explanatory drawing of an ion introduction electrode in a sixth example as viewed from the direction of an ion source.
FIG. 15(B) is an explanatory drawing of a section of an ion introduction electrode in the sixth example taken along the central axis thereof.
Figure 15:
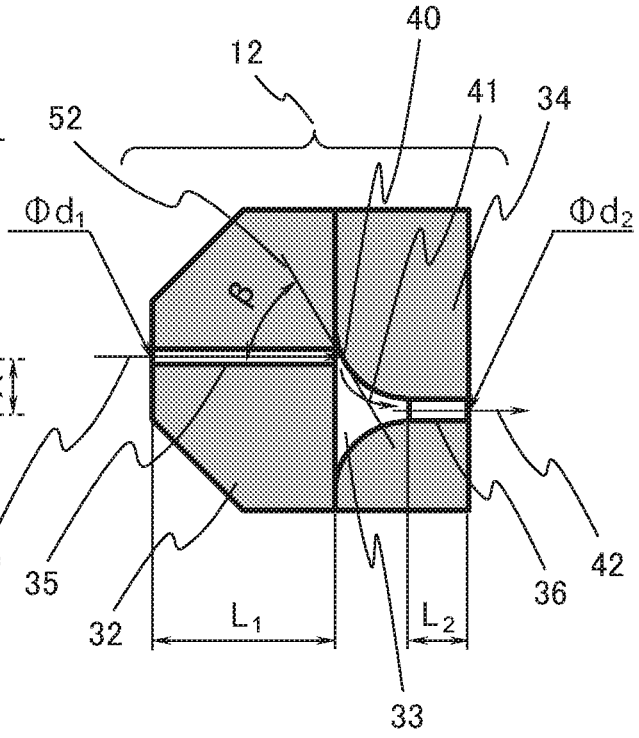

A detailed description will be given to a configuration of an ion introduction electrode 12 in the sixth example with reference to FIGS. 15(A) and 15(B). FIG. 15(A) illustrates the ion introduction electrode 12 as viewed from the direction of an ion source 2; and FIG. 15(B) is a cross-sectional view of the ion introduction electrode 12 taken along the central axis thereof. The ion introduction electrode 12 shown in FIG. 15(B) is basically substantially identical with the ion introduction electrode 12 described with reference to FIG. 2(B) in configuration and function. Therefore, a redundant description will be omitted and only a difference from the configuration shown in FIG. 2(B) will be described. In the ion introduction electrode 12 shown in FIG. 15(B), the intermediate pressure chamber 33 is in such a shape (trumpet shape) that the cross-sectional shape thereof is not linearly changed like tapers but is curvilinearly changed. In the case of this configuration, an incident angle $\beta$ is formed by a curved tangential line 52 at a section at a collision point 40. The intermediate pressure chamber 33 in FIG. 15(B) is also in such a shape that the cross-sectional area of the interior thereof is continuously reduced as it goes along the traveling direction of ions; therefore, the same effects as described with reference to FIG. 2(B) can be basically obtained. Since the tangential angle of a section of the intermediate pressure chamber 33 is continuously and gently changed with traveling of ions, ions can be introduced into the rear-stage first pore 36 with a less loss.

Like the ion introduction electrode 12 shown in FIG. 2(B), the ion introduction electrode 12 in FIG. 15(B) can also be combined with the equipment configuration described with reference to FIG. 1.

Example 7

In relation to a seventh example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the seventh example is characterized in that the intermediate pressure chamber has such a shape that the cross-sectional area of the interior thereof is stepwise reduced as it goes along the traveling direction of ions.

Figure 16:
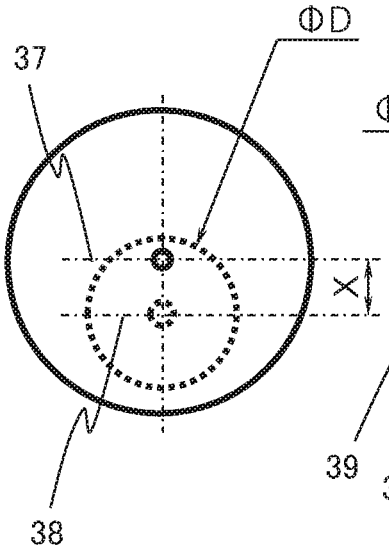
FIG. 16(A) is an explanatory drawing of an ion introduction electrode in a seventh example as viewed from the direction of an ion source.
FIG. 16(B) is an explanatory drawing of a section of an ion introduction electrode in the seventh example taken along the central axis thereof.
Figure 16:
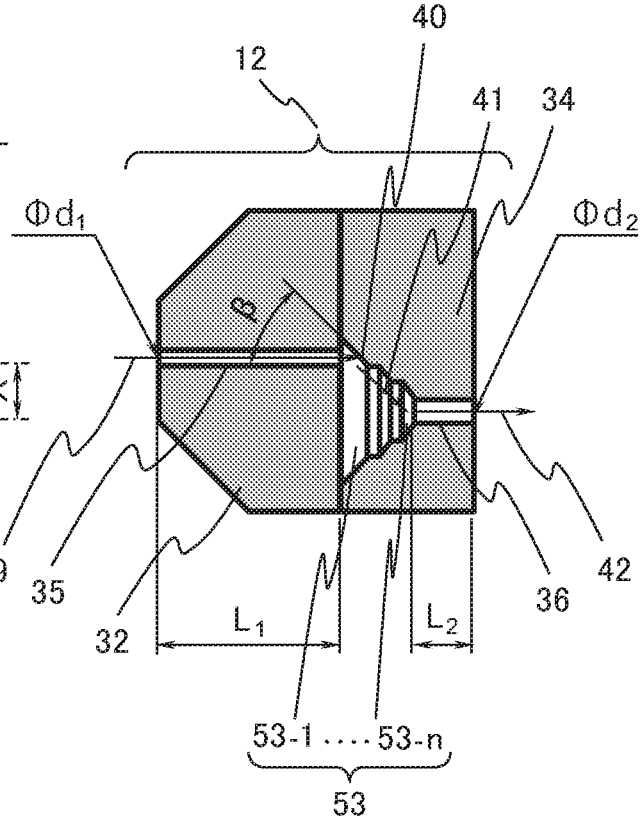

A detailed description will be given to a configuration of an ion introduction electrode 12 in the seventh example with reference to FIGS. 16(A) and 16(B). FIG. 16(A) illustrates the ion introduction electrode 12 as viewed from the direction of an ion source 2; and FIG. 16(B) is a cross-sectional view of the ion introduction electrode 12 taken along the central axis thereof. The ion introduction electrode 12 shown in FIG. 16(B) is basically substantially identical with the ion introduction electrode 12 described with reference to FIG. 2(B) in configuration and function. Therefore, a redundant description will be omitted and only a difference from the configuration shown in FIG. 2(B) will be described. In the ion introduction electrode 12 shown in FIG. 16(B), the intermediate pressure chamber 53 is composed of multiple stair-like stepped portions 53-1 to **53-*n*. The stepped portions 53-1 to 53-*n* are in such a shape that the cross-sectional area of the interior thereof is stepwise reduced as it goes along the traveling direction of ions. The structure of the intermediate pressure chamber 53 shown in FIG. 16(B) is in such a shape that the cross-sectional area of the interior thereof is stepwise reduced as it goes along the direction of ions. Even in this shape, the same functions as described with reference to FIG. 2(B) can be obtained. When a straight cylindrical portion partly exists as shown in FIG. 16(B), no problem arises. It is desirable that the collision point 40 should be located in a taper shape as shown in FIG. 16(B). However, if the collision point is located on a curved surface as in the fourth example or the sixth example, no problem arises. Further, if the collision point 40 is located in a position overlapped with a stair-like step, no problem arises. However, in cases where the collision point 40** is overlapped with a step, an axial offset X is of the order of millimeters and thus it is desirable that a step pitch should be set to as sufficiently smaller a value as 0.1 mm or so.

Like the ion introduction electrode 12 shown in FIG. 2(B), the ion introduction electrode 12 in FIG. 16(B) can also be combined with the equipment configuration described with reference to FIG. 1.

Example 8

In relation to an eighth example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the eighth example is characterized in that the intermediate pressure chamber in such a shape that the cross-sectional area of the interior thereof is continuously reduced as it goes along the traveling direction of ions is configured as follows: there is a sloped portion only on the front-stage first pore side as viewed from the rear-stage first pore.

Figure 17:
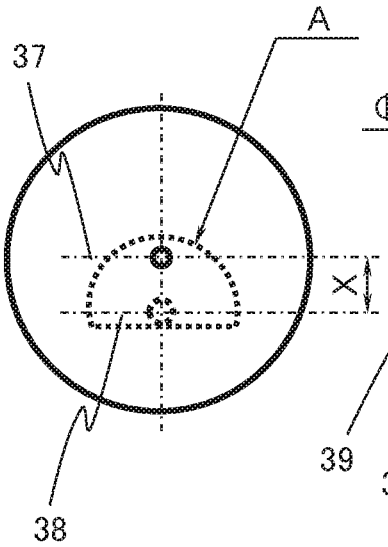
FIG. 17(A) is an explanatory drawing of an ion introduction electrode in an eighth example as viewed from the direction of an ion source.
FIG. 17(B) is an explanatory drawing of a section of an ion introduction electrode in the eighth example taken along the central axis thereof.
Figure 17:
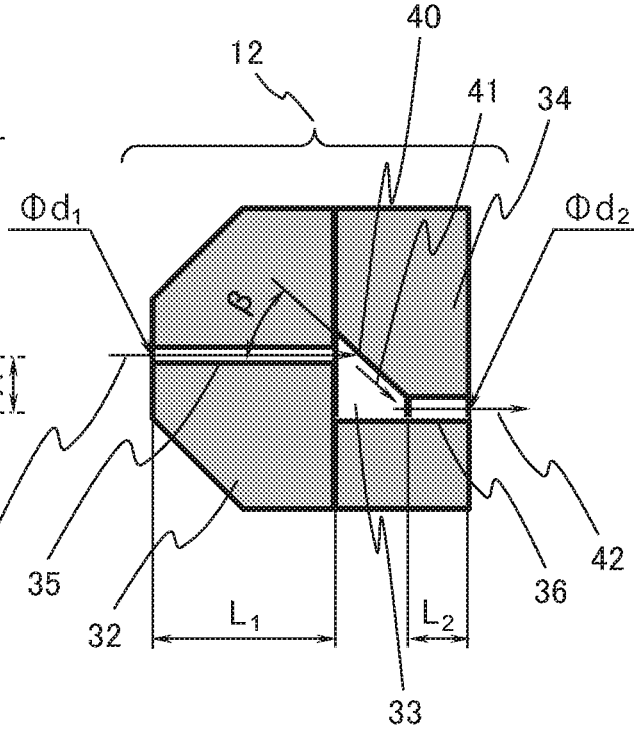

A detailed description will be given to a configuration of an ion introduction electrode 12 in the eighth example with reference to FIGS. 17(A) and 17(B). FIG. 17(A) illustrates the ion introduction electrode 12 as viewed from the direction of an ion source 2; and FIG. 17(B) is a cross-sectional view of the ion introduction electrode 12 taken along the central axis thereof. The ion introduction electrode 12 shown in FIG. 17(B) is basically substantially identical with the ion introduction electrode 12 described with reference to FIG. 2(B) in configuration and function. Therefore, a redundant description will be omitted and only a difference from the configuration shown in FIG. 2(B) will be described. In the ion introduction electrode 12 shown in FIG. 17(B), the intermediate pressure chamber 33 is not symmetrical with respect to the central axis 38 of the rear-stage first pore 36 like tapers. The intermediate pressure chamber is in such a shape that there is a sloped portion only in the direction of the central axis 37 of the front-stage first pore 35 as viewed from the central axis 38 of the rear-stage first pore 36. In this case, the inlet area A of the intermediate pressure chamber 33 only has to be approximately half of a taper inlet area $mm^2$ or so, which is a desirable condition described in relation to the first example and this enables sufficient size reduction. A condition of A 6 $mm^2$ or so is desirable for size. Since an inlet area is reduced, a pressure difference from the front-stage first pore 35 becomes smaller than in the case shown in FIG. 2(B); however, an ion loss is accordingly made relatively small. The intermediate pressure chamber 33 in FIG. 17(B) is also in such a shape that the cross-sectional area of the interior thereof is continuously reduced as it goes along the traveling direction of ions; therefore, the same effects as described with reference to FIG. 2(B) can be basically obtained.

Like the ion introduction electrode 12 shown in FIG. 2(B), the ion introduction electrode 12 in FIG. 17(B) can also be combined with the equipment configuration described with reference to FIG. 1.

Example 9

In relation to a ninth example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the ninth example is characterized in that: there is provided the intermediate pressure chamber in such a shape that the cross-sectional area of the interior thereof is continuously reduced as it goes along the traveling direction of ions; and there are multiple front-stage first pores.

Figure 18:
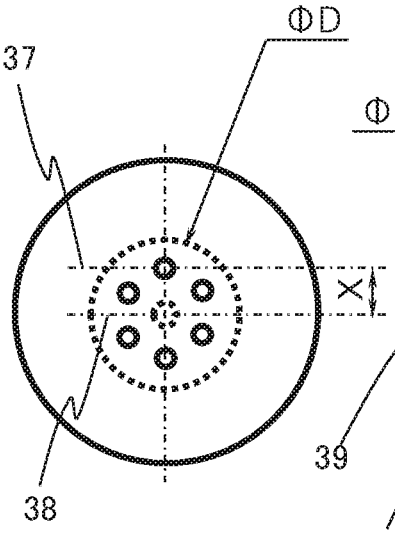
FIG. 18(A) is an explanatory drawing of an ion introduction electrode in a ninth example as viewed from the direction of an ion source.
FIG. 18(B) is an explanatory drawing of a section of an ion introduction electrode in the ninth example taken along the central axis thereof.
Figure 18:
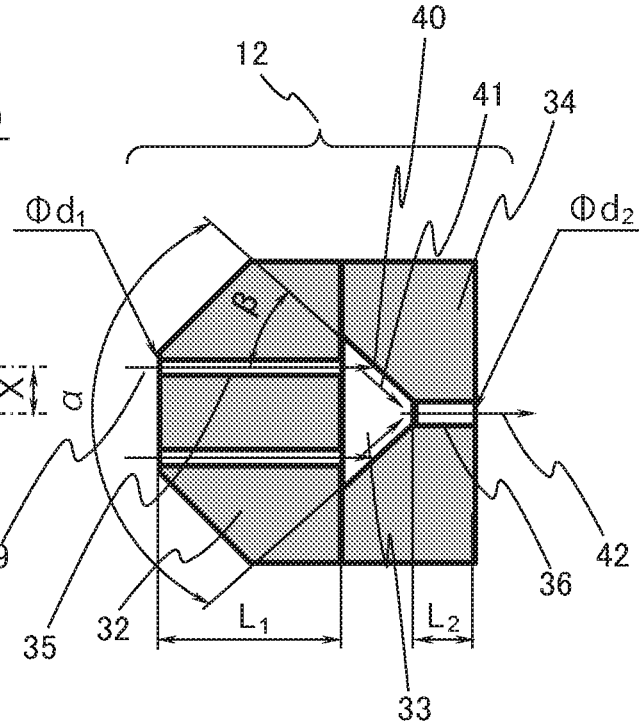

A detailed description will be given to a configuration of an ion introduction electrode 12 in the ninth example with reference to FIGS. 18(A) and 18(B). FIG. 18(A) illustrates the ion introduction electrode 12 as viewed from the direction of an ion source 2; and FIG. 18(B) is a cross-sectional view of the ion introduction electrode 12 taken along the central axis thereof. The ion introduction electrode 12 shown in FIG. 18(B) is basically substantially identical with the ion introduction electrode 12 described with reference to FIG. 2(B) in configuration and function. Therefore, a redundant description will be omitted and only a difference from the configuration shown in FIG. 2(B) will be described. The ion introduction electrode 12 shown in FIG. 18(B) is characterized in that there are multiple front-stage first pores 35. In the example in FIG. 18(B), a number of the front-stage first pores 35 is six but any number of front-stage first pores 35 is acceptable. Increasing a number of the front-stage first pores 35 increases the amount of flow introduced into the intermediate pressure chamber 33 by an amount equivalent to the number of the front-stage first pores 35. However, since the intermediate pressure chamber 33 in FIG. 18(B) is also in such a shape that the cross-sectional area of the interior thereof is continuously reduced as it goes along the traveling direction of ions, the same effects as described with reference to FIG. 2(B) can be basically obtained.

Like the ion introduction electrode 12 shown in FIG. 2(B), the ion introduction electrode 12 in FIG. 18(B) can also be combined with the equipment configuration described with reference to FIG. 1. The front-stage first pores 35 in FIG. 18(B) can be combined with the configurations of the intermediate pressure chambers 33 shown in FIG. 11(B) to FIG. 17(B).

Example 10

In relation to a 10th example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the 10th example is characterized in that: there is provided the intermediate pressure chamber in such a shape that the cross-sectional area of the interior thereof is continuously reduced as it goes along the traveling direction of ions; and the front-stage first pore and the intermediate pressure chamber are so structured that they are electrically insulated from each other.

Figure 19:
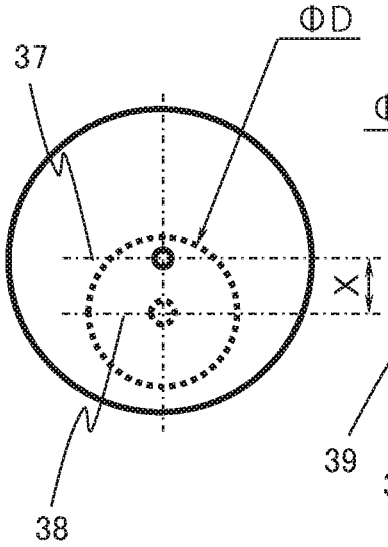
FIG. 19(A) is an explanatory drawing of an ion introduction electrode in a 10th example as viewed from the direction of an ion source.
FIG. 19(B) is an explanatory drawing of a section of an ion introduction electrode in the 10th example taken along the central axis thereof.
Figure 19:
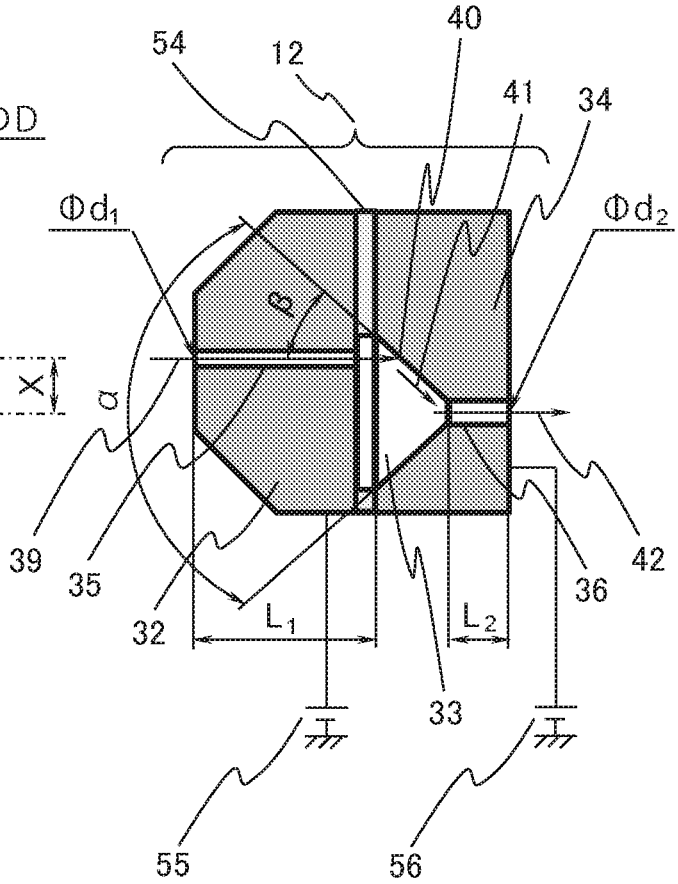

A detailed description will be given to a configuration of an ion introduction electrode 12 in the 10th example with reference to FIGS. 19(A) and 19(B). FIG. 19(A) illustrates the ion introduction electrode 12 as viewed from the direction of an ion source 2; and FIG. 19(B) is a cross-sectional view of the ion introduction electrode 12 taken along the central axis thereof. The ion introduction electrode 12 shown in FIG. 19(B) is basically substantially identical with the ion introduction electrode 12 described with reference to FIG. 2(B) in configuration and function. Therefore, a redundant description will be omitted and only a difference from the configuration shown in FIG. 2(B) will be described. The ion introduction electrode 12 shown in FIG. 19(B) is characterized in that the front-stage member 32 and the rear-stage member 34 can be electrically insulated from each other by an insulator 54. Since the front-stage member 32 and the rear-stage member 34 are electrically insulated from each other, independent different potentials can be applied thereto from power supplies 55, 56. In FIG. 19(B), the intermediate pressure chamber 33 and the rear-stage first pore 36 are depicted as a single member. Instead, the intermediate pressure chamber 33 and the rear-stage first pore 36 may also be formed of separate members and be electrically insulated from each other by an insulator. Since the intermediate pressure chamber 33 in FIG. 19(B) is also in such a shape that the cross-sectional area of the interior thereof is continuously reduced as it goes along the traveling direction of ions, the same effects as described with reference to FIG. 2(B) can be basically obtained.

Like the ion introduction electrode 12 shown in FIG. 2, the ion introduction electrode 12 in FIG. 19(B) can also be combined with the equipment configuration described with reference to FIG. 1. The insulating structure in FIG. 19(B) can be combined with the configurations of the ion introduction electrodes 12 in FIG. 11(B) to FIG. 18(B).

Example 11

In relation to an 11th example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the 11th example is characterized in that there are provided the intermediate pressure chamber in such a shape that the cross-sectional area of the interior thereof is continuously reduced as it goes along the traveling direction of ions and a heating means for heating the ion introduction electrode.

Figure 20:
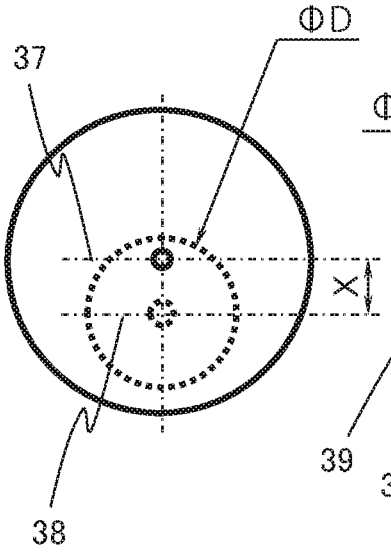
FIG. 20(A) is an explanatory drawing of an ion introduction electrode in an 11th example as viewed from the direction of an ion source.
FIG. 20(B) is an explanatory drawing of a section of an ion introduction electrode in the 11th example taken along the central axis thereof.
Figure 20:
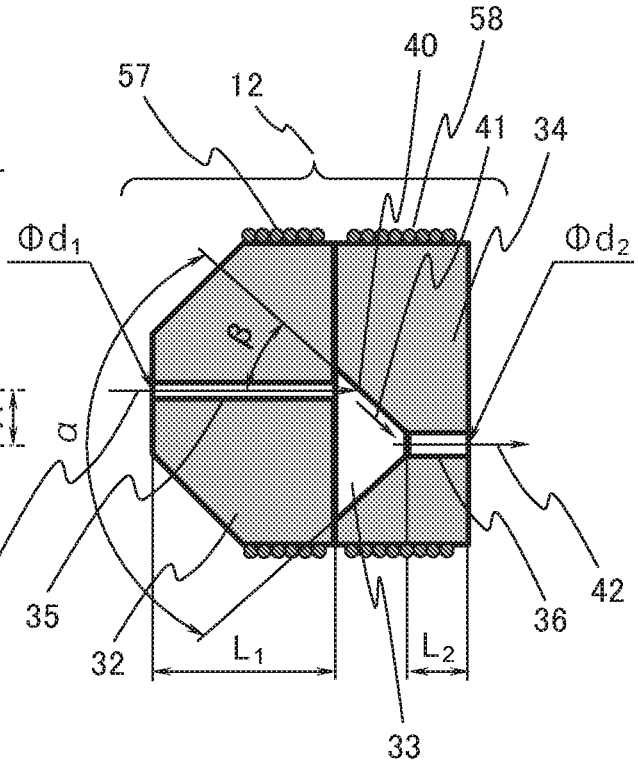

A detailed description will be given to a configuration of an ion introduction electrode 12 in the 11th example with reference to FIGS. 20(A) and 20(B). FIG. 20(A) illustrates the ion introduction electrode 12 as viewed from the direction of an ion source 2; and FIG. 20(B) is a cross-sectional view of the ion introduction electrode 12 taken along the central axis thereof. The ion introduction electrode 12 shown in FIG. 20(B) is basically substantially identical with the ion introduction electrode 12 described with reference to FIG. 2(B) in configuration and function. Therefore, a redundant description will be omitted and only a difference from the configuration shown in FIG. 2(B) will be described. The ion introduction electrode 12 shown in FIG. 20(B) is characterized in that there are provided heating means 57, 58 for heating the ion introduction electrode 12. Heating the ion introduction electrode 12 makes it possible to evaporate and vaporize droplets 8 introduced into the ion introduction electrode 12 and suppress the inflow of droplets 8 to the subsequent area. In the example in FIG. 20(B), the front-stage member 32 and the rear-stage member 34 are independently heated with the separate heating means 57, 58 but both the members may be heated with a single heating means. Further, a part of the intermediate pressure chamber 33 and a part of the rear-stage first pore 36 may be independently heated with separate heating means. FIG. 20(B) depicts that the heating means 57, 58 are coiled heating wires but the heating means may be a heater or the like in any other form.

Like the ion introduction electrode 12 shown in FIG. 2(B), the ion introduction electrode 12 in FIG. 20(B) can also be combined with the equipment configuration described with reference to FIG. 1. The ion introduction electrode 12 in FIG. 20(B) can be combined with the configurations of the ion introduction electrodes 12 in FIG. 11(B) to FIG. 19(B).

Example 12

Figure 21:
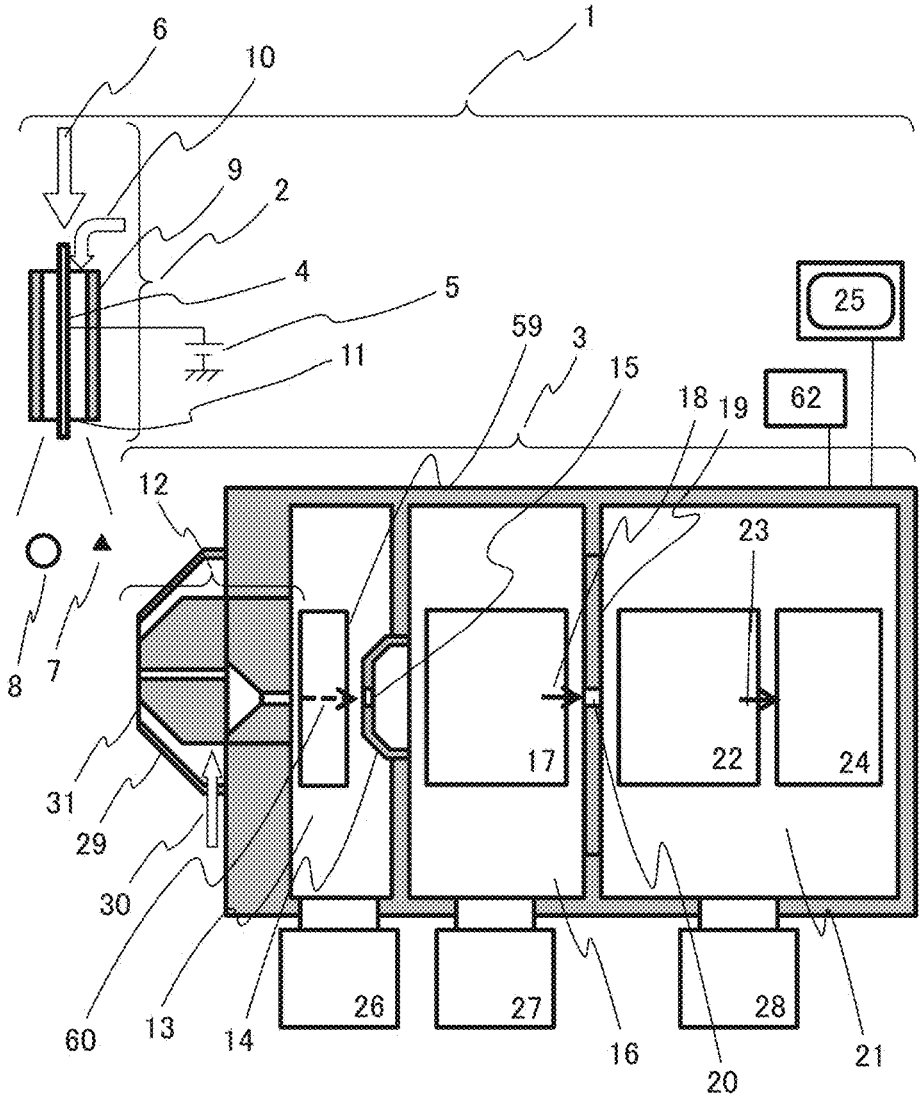
FIG. 21 is an equipment configuration drawing of a 12th example.

In relation to a 12th example, a description will be given to an equipment configuration in which an ion introduction electrode for introducing ions from under atmospheric pressure into vacuum is composed of three elements: a front-stage first pore, an intermediate pressure chamber, and a rear-stage first pore. The equipment configuration of the 12th example is characterized in that: there is provided the intermediate pressure chamber in such a shape that the cross-sectional area of the interior thereof is continuously reduced as it goes along the traveling direction of ions; and a first vacuum chamber is provided with an ion convergence unit. A detailed description will be given to a configuration of a mass spectrometry device 1 in the 12th example with reference to FIG. 21. The mass spectrometry device 1 shown in FIG. 21 is basically substantially identical with the mass spectrometry device 1 described with reference to FIG. 1 in configuration and function. Therefore, a redundant description will be omitted and only a difference from the configuration in FIG. 1 will be described. The mass spectrometry device 1 shown in FIG. 21 is characterized in that an ion convergence unit 59 is disposed in the first vacuum chamber 13. The ion convergence unit 59 can be formed of multiple ring-shaped electrodes or multiple rod-shaped electrodes and applies direct-current voltage or alternating-current voltage (including high-frequency voltage) or simultaneously both of these voltages. Ions are thereby converged in proximity to the central axis thereof. Ions 7 that passed through the ion introduction electrode 12 and were introduced into the first vacuum chamber 13 are converged by the ion convergence unit 59 in proximity to the central axis 60 thereof. As a result, the efficiency of ion introduction into a hole 15 in a subsequent second pore electrode 14 is enhanced and thus sensitivity is enhanced. Other configuration elements and the like are the same as those described with reference to FIG. 1. When used, direct-current or alternating-current voltage is applied from a power supply 62 to the ion convergence unit 59.

It is also possible to combine the ion introduction electrodes 12 in FIG. 2(B) and FIG. 11(B) to FIG. 20(B) with the mass spectrometry device 1 in FIG. 21.

REFERENCE SIGNS LIST

1 . . . Mass spectrometry device,
2 . . . Ion source,
3 . . . Vacuum vessel,
4 . . . Metal capillary,
5 . . . Power supply,
6 . . . Sample solution,
7 . . . Ion,
8 . . . Droplet,
9 . . . Pipe,
10 . . . Gas,
11 . . . Outlet end,
12 . . . Ion introduction electrode,
13 . . . First vacuum chamber,
14 . . . Second pore electrode,
15 . . . Hole,
16 . . . Second vacuum chamber,
17 . . . Ion transport unit,
18 . . . Ion,
19 . . . Third pore electrode,
20 . . . Hole,
21 . . . Third vacuum chamber,
22 . . . Ion analysis unit,
23 . . . Ion,
24 . . . Detector,
25 . . . Control unit,
26 . . . Rotary pump (RP),
27 . . . Turbo molecular pump (TMP),
28 . . . Turbo molecular pump (TMP),
29 . . . Electrode,
30 . . . Gas,
31 . . . Outlet end,
32 . . . Front-stage member,
33 . . . Intermediate pressure chamber,
33-1 . . . Front-stage portion,
33-2 . . . Rear-stage portion,
34 . . . Rear-stage member,
35 . . . Front-stage first pore,
36 . . . Rear-stage first pore,
37 . . . Central axis,
38 . . . Central axis,
39 . . . Line,
40 . . . Collision point,
41 . . . Line,
42 . . . Line,
43 . . . Droplet noise intensity,
44 . . . ion intensity,
45 . . . Comparison result depending on presence or absence of intermediate pressure chamber,
46 . . . Comparison result depending on structure of rear-stage first pore,
47 . . . Fluid simulation result,
48 . . . Extension line of taper angle,
49 . . . Range,
50 . . . Cross point,
51 . . . Outlet end,
52 . . . Tangential line,
53 . . . Intermediate pressure chamber,
53-1 to **53-*n*** . . . Stepped portion,
54 . . . Insulator,
55 . . . Power supply,
56 . . . Power supply,
57 . . . Heating means,
58 . . . Heating means,
59 . . . Ion convergence unit,
60 . . . Central axis,
61 . . . Internal pressure ($P_M$) dependence result with intermediate pressure chamber,
62 . . . Power supply.

The invention claimed is:

1. A mass spectrometry device comprising:
an ion source for generating ions;
a vacuum chamber that is evacuated by an evacuation means and for analyzing the mass of the ions; and
an ion introduction electrode for introducing the ions into the vacuum chamber,
wherein the ion introduction electrode comprises a front-stage pore on the ion source side, a rear-stage pore on the vacuum chamber side, and an intermediate pressure chamber located between the front-stage pore and the rear-stage pore,
wherein a cross-sectional area of an ion inlet of the intermediate pressure chamber is larger than a cross-sectional area of the front-stage pore,
wherein a central axis of the front-stage pore and a central axis of the rear-stage pore are eccentrically positioned, and
wherein the cross-sectional area of an ion outlet of the intermediate pressure chamber is smaller than the cross-sectional area of the ion inlet of the intermediate pressure chamber.

2. The mass spectrometry device according to claim 1,
wherein an angle formed between a wall surface of the intermediate pressure chamber and the central axis direction of the front-stage pore is acute.

3. The mass spectrometry device according to claim 1,
wherein an angle formed between a wall surface of the intermediate pressure chamber and the central axis direction of the front-stage pore is 15° to 75°.

4. The mass spectrometry device according to claim 1,
wherein an outlet end of the rear-stage pore is located on a downstream side of an extension line connecting the ion inlet and the ion outlet of the intermediate pressure chamber.

5. The mass spectrometry device according to claim 1,
wherein a ratio of a length L to an inside diameter D of the rear-stage pore is 0.3 or above.

6. The mass spectrometry device according to claim 1,
wherein a pressure of the intermediate pressure chamber is 2000 to 30000 Pa.

7. The mass spectrometry device according to claim 1,
wherein a heater is provided for heating the ion introduction electrode.

8. The mass spectrometry device according to claim 1,
wherein an ion convergence unit is provided for converging ions exiting from the rear-stage pore.

9. The mass spectrometry device according to claim 1,
wherein letting a primary-side pressure of the front-stage pore be $P_o$ and a secondary-side pressure of the front-stage pore be $P_M$, $P_M/P_o \leq 0.5$.

10. The mass spectrometry device according to claim 1,
wherein a wall surface of the intermediate pressure chamber has a plurality of angles from the ion inlet to the ion outlet of the intermediate pressure chamber.

11. The mass spectrometry device according to claim 10,
wherein as for the angle of the intermediate pressure chamber to the central axis direction of the front-stage pore, a portion of 0° is provided on the front-stage pore side.

12. The mass spectrometry device according to claim 10, wherein as for the angle of the intermediate pressure chamber to the central axis direction of the front-stage pore, the angle on the front-stage pore side is smaller than the angle on the rear-stage pore side.

13. The mass spectrometry device according to claim 10, wherein as for the angle of the intermediate pressure chamber to the central axis direction of the front-stage pore, the angle on the front-stage pore side is larger than the angle on the rear-stage pore side.

14. The mass spectrometry device according to claim 1, wherein as for an angle of the intermediate pressure chamber to the central axis direction of the front-stage pore, the angle of the wall surface of the intermediate pressure chamber is continuously increased from the ion inlet to the ion outlet of the intermediate pressure chamber.

15. The mass spectrometry device according to claim 1, wherein as for an angle of the intermediate pressure chamber to the central axis direction of the front-stage pore, the angle of the wall surface of the intermediate pressure chamber is continuously reduced from the ion inlet to the ion outlet of the intermediate pressure chamber.

16. The mass spectrometry device according to claim 1, wherein a first member having the front-stage pore and a second member having the intermediate pressure chamber are provided and the first member and the second member are electrically insulated from each other by an insulator.

* * * * *